US007480389B2

(12) United States Patent
Ricks et al.

(10) Patent No.: US 7,480,389 B2
(45) Date of Patent: Jan. 20, 2009

(54) SOUND DIRECTION SYSTEM

(75) Inventors: Bradley Joel Ricks, Carrollton, TX (US); Andrew Rutkin, Newbury Park, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 659 days.

(21) Appl. No.: 10/093,230

(22) Filed: Mar. 7, 2002

(65) Prior Publication Data

US 2002/0125066 A1 Sep. 12, 2002

Related U.S. Application Data

(60) Provisional application No. 60/273,867, filed on Mar. 7, 2001.

(51) Int. Cl.
*H04R 1/02* (2006.01)
*H04R 9/06* (2006.01)

(52) U.S. Cl. ..... 381/335

(58) Field of Classification Search ..... 381/335, 381/89, 182, 186
See application file for complete search history.

(56) References Cited

U.S. PATENT DOCUMENTS 4,472,834 A 9/1984 Yamamuro et al.
4,845,759 A 7/1989 Danley
5,058,169 A 10/1991 Temmer
5,099,948 A * 3/1992 Melhart ..... 181/152
5,764,595 A * 6/1998 Power ..... 367/103
5,850,460 A * 12/1998 Tanaka et al. ..... 381/186
6,128,395 A * 10/2000 De Vries ..... 381/387
6,650,758 B1 * 11/2003 Van Schyndel ..... 381/97

OTHER PUBLICATIONS

Wikipedia.com definition of Trapezoid.*
"Forward Steered Arrays in Precision Directivity™ Speaker Systems," published in *JBL Professional*, Technical Notes vol. 1, No. 28, Aug. 21, 2001.
"Panaray® MB4 4x Endfire Bass Array/ Panaray® MB4 2x Endfire Bass Array/ Panaray® MB4 2x Broadside Bass Array," 2001 BOSE Corporation, The Mountain.

* cited by examiner

*Primary Examiner*—Suhan Ni
*Assistant Examiner*—Andrew C Flanders

(57) ABSTRACT

This invention provides a sound source system capable of producing a desired coverage pattern with high SPL that may be steered towards a desired listening area. The sound source system may provide an array of sound sources where the coverage pattern and SPL may depend on the height, width, and depth of the assembled array. Adding height and width to the array may narrow the vertical and horizontal coverage patterns that are projected, respectively. To maintain a substantially constant coverage pattern, a frequency shading techniques may be used to keep the height of the array constant relative to the wavelength. Adding depth to the array may provide greater SPL with minimal effect on the coverage pattern because array's height and width have not changed. The sound source system may also coherently sum in the main lobe and provide substantial off-axis rejection. This may be done using an end-fired related principle where each sound source in the array may be delayed proportional to its delay distance. The delay distance for each sound source may be the shortest distance between the sound source and the reference plane. This allows the sound source system to provide a desired coverage pattern with a desired SPL.

45 Claims, 18 Drawing Sheets

800

804
806
808
810
812
611
621
631
612
645
814
DELAY 21
816
DELAY 31
818
DELAY 12
820
DELAY 45
822
824
826
828
830
802
AUDIO SIGNAL SOURCE
AP
803

FIG. 17
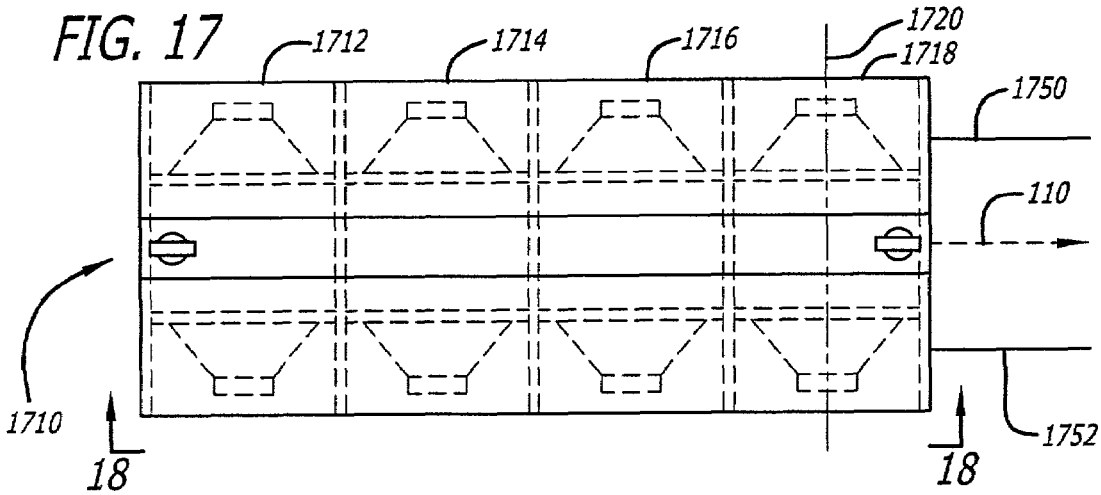
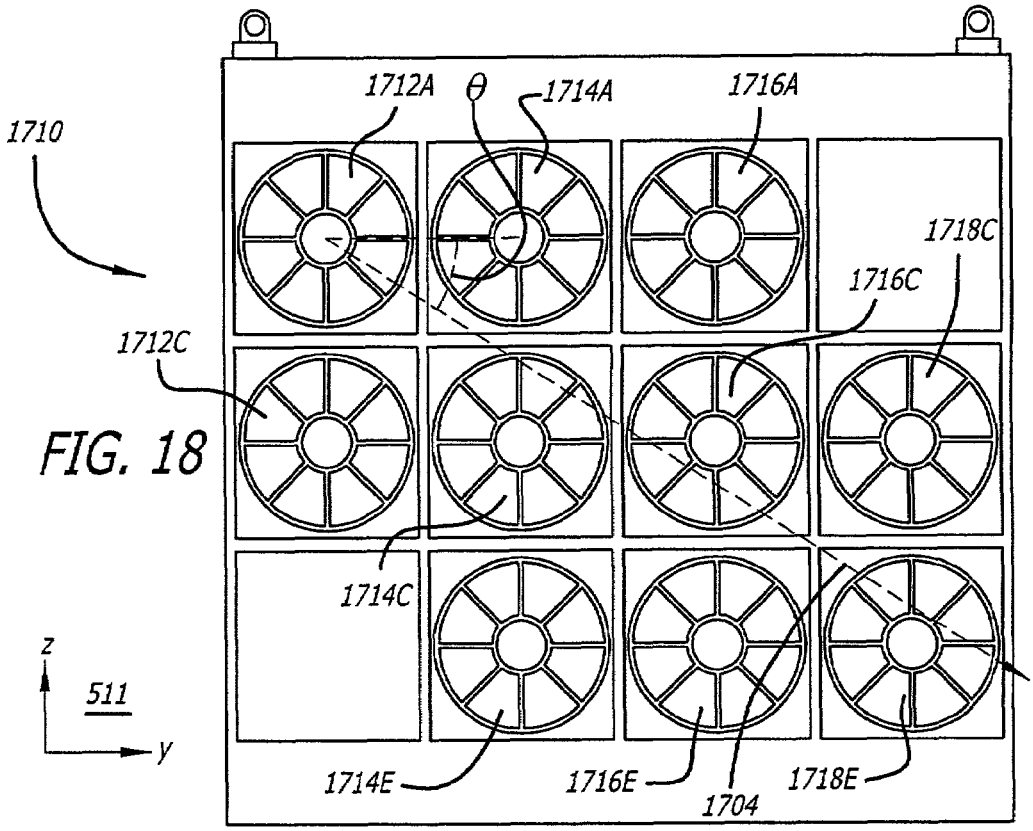
FIG. 18
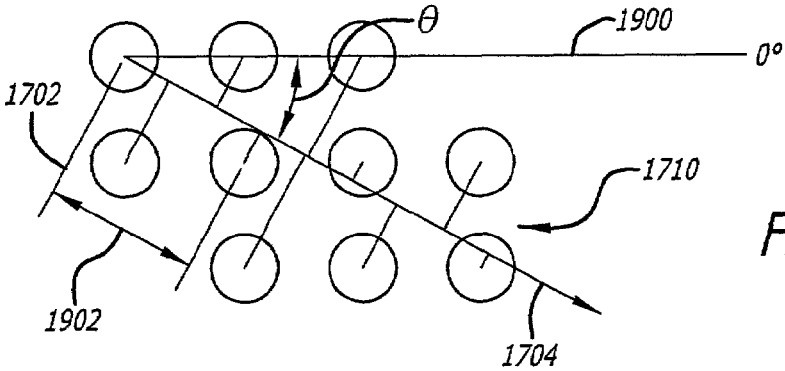
FIG. 19

FIG. 22
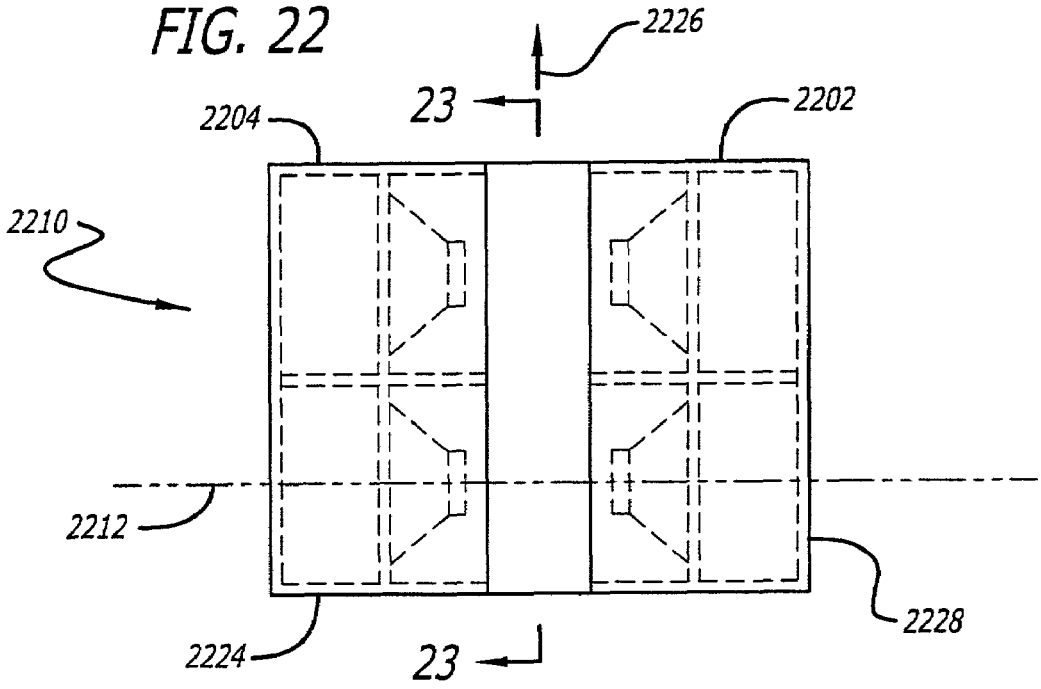
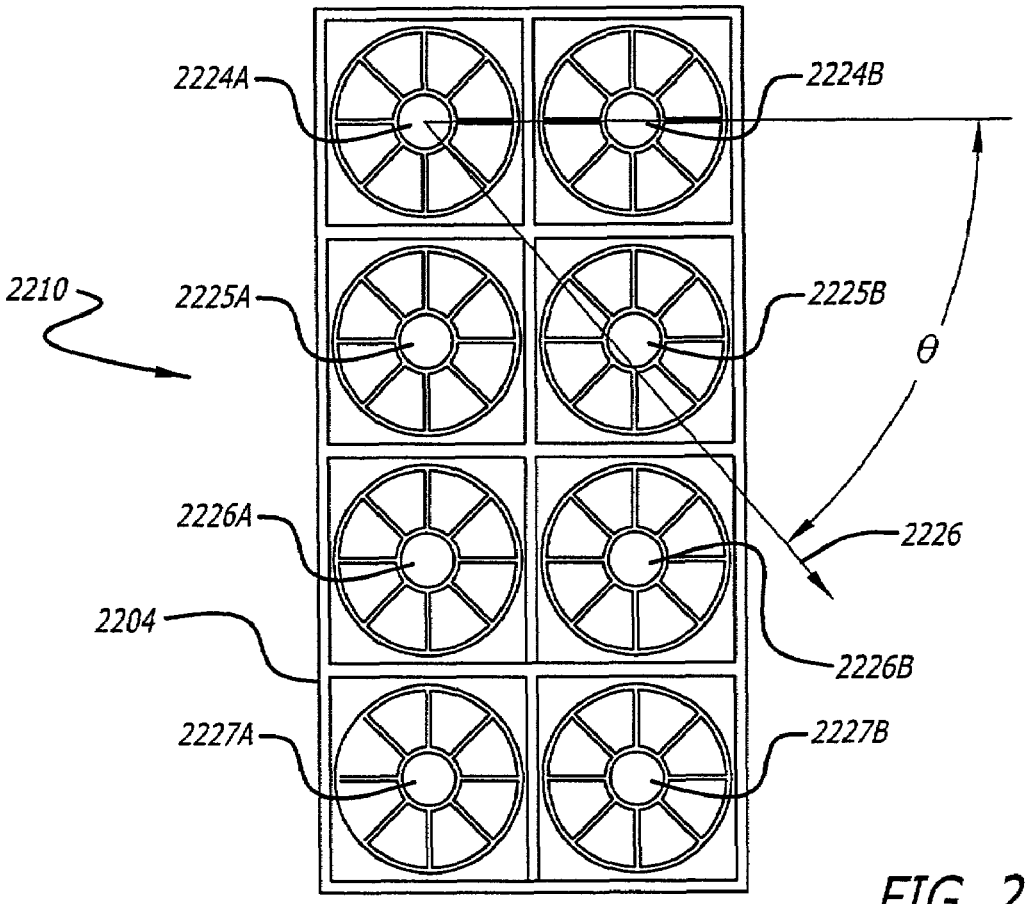
FIG. 23

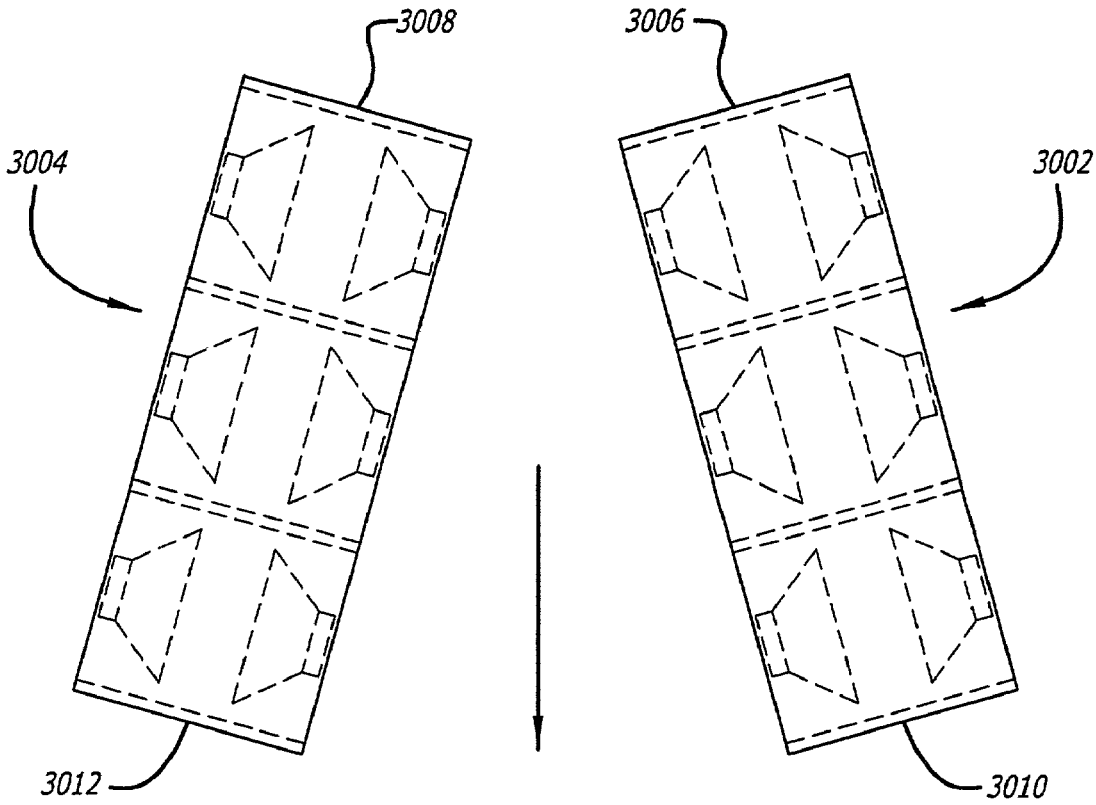
FIG. 30
FIG. 31
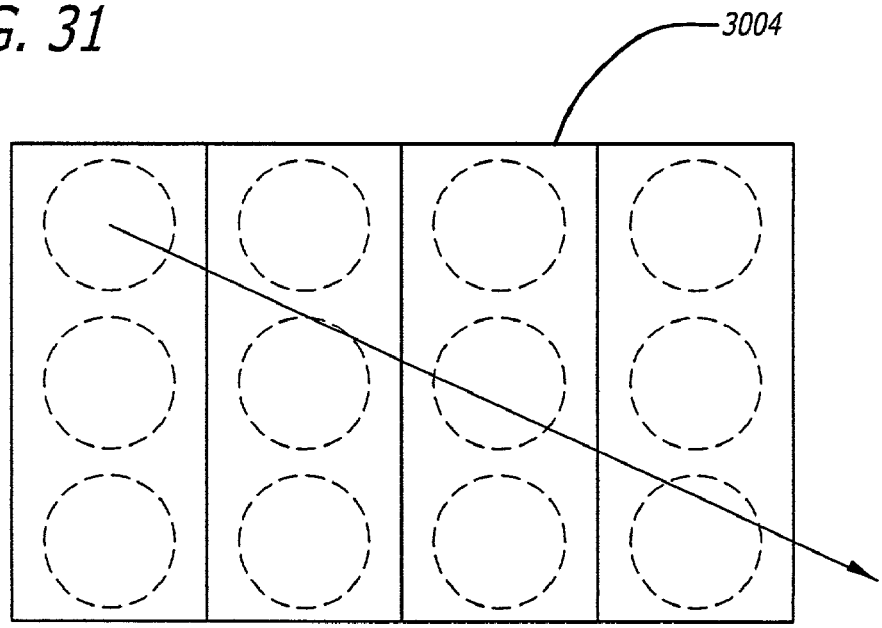

SOUND DIRECTION SYSTEM

CROSS REFERENCE TO RELATED APPLICATIONS

This application claims priority from U.S. Provisional Patent Application, Serial No. 60/273,867 filed Mar. 7, 2001 and is incorporated by reference.

BACKGROUND OF THE INVENTION

1. Field of the Invention

This invention provides a sound source system capable of producing a desired coverage pattern with a high sound pressure level that may be steered towards a desired listening area.

2. General Background and State of the Art

In sound reinforcement applications, a sound source that produces an effective high sound pressure level (SPL) may be desired at low frequencies. This is often accomplished by forming an array of sound sources that are stacked together to increase the SPL. As each of the sound sources in the array generate sound, they add to generate a main lobe of sound energy, and depending on how the array is configured, other side lobes of sound energy may be generated as well. The main lobe and the side lobes of sound energy form a coverage pattern of sound energy that has increased SPL on axis, however, the main lobe of energy may become excessively narrow and the side lobes may be undesirable.

As the array increases in size, the coverage pattern may become narrower. For example, a taller array will generally have a narrower vertical coverage pattern than a shorter array. And a wider array will generally have a narrower horizontal coverage pattern than a narrow array. This narrowing may be desirable in some instances, but it can also limit the number of low-frequency sound sources that can be effectively added to an array. This can be a problem where a wider or more consistent coverage pattern is desired without the detrimental effects of lobing, where there are dips and peaks in the response. Excessive narrowing may also occur when using a large curved array of speakers. In addition, an array may be inefficient and may not provide a great deal of useful off-axis attenuation—that is rejection directly behind the array. Therefore, there is a need for a sound source system that is capable of directing the coverage pattern with high SPL at low frequencies without the problem of narrowing the coverage pattern.

SUMMARY

This invention provides a sound source system capable of producing a desired coverage pattern with high SPL that may be steered towards a desired listening area. The sound source system may provide an array of sound sources where the coverage pattern and SPL may depend on the height, width, and depth of the assembled array. Adding height and width to the array may narrow the vertical and horizontal coverage patterns that are projected, respectively. To maintain a substantially constant coverage pattern, a frequency shading techniques may be used to keep the height of the array constant relative to the wavelength. Adding depth to the array may provide greater SPL with minimal effect on the coverage pattern because array's height and width have not changed. This allows the sound source system to provide a desired coverage pattern with a desired SPL.

The sound source system may also coherently sum in the main lobe and provide substantial off-axis rejection. This may be done using an end-fired related principle where each sound source in the array may be delayed proportional to its delay distance. The delay distance for each sound source may be the shortest distance between the sound source and the reference plane. Based on the respective delay distance for each sound source, a processor may delay the audio signal for each sound source by dividing the delay distance by the speed of sound. With such delays, the sound energy from each sound source may be aligned normal to the reference plane, creating a coherent lobe of energy from the array that is normal to the reference plane. For steering, the reference plane may be rotated vertically relative to a given angle that causes the main lobe of energy from the array to be directed at that given angle.

A variety of array configurations may be developed for a particular application by trading off height, width, depth, and delay settings in the array. For example, an array may include four or more dual-sound source elements that may be steered at an angle between 0 and −90 degrees from the reference axis that may be horizontal. The steering may be accomplished by delaying each low frequency sound source element back to a reference plane that is normal to the direction that the array is steered. The resulting sound energy is pushed forward, coherently summing in the direction of aiming and minimizing energy directed off-axis.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

FIG. 17 is a top view of a sound source system having four columns and three rows of sound source elements of FIG. 9.

FIG. 18 is a side view of the sound source system of FIG. 17.

FIG. 19 is a schematic diagram of the sound source system of FIG. 18.

FIG. 22 is a top view of a sound source system comprised of the sound source elements of FIGS. 13 and 14.

FIG. 23 is a cross-sectional view along 23-23 of the sound source system of FIG. 22.

FIG. 30 is a top view of two sound source systems angled towards each other.

FIG. 31 is a side view of the two sound source systems of FIG. 30.

DETAILED DESCRIPTION OF THE PREFERRED EMBODIMENTS

Figure 1:
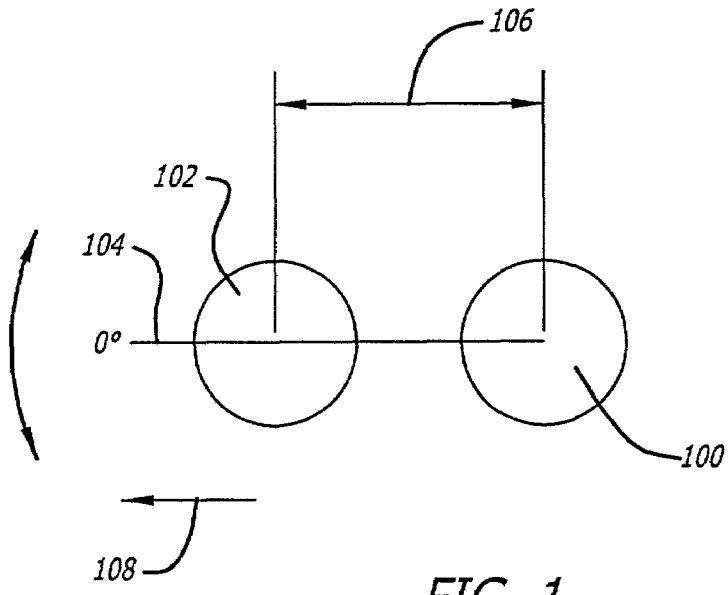
FIG. 1 illustrates a sound source system having two sound sources arranged in an array.

Driving a group of sound sources with signals delayed relative to a common physical reference may provide a relatively high directivity of sound. FIG. 1 illustrates two sound sources 100 and 102 that have a delay distance 106 apart along an axis 104 that is in the direction of the aiming 108. FIGS. 2A through 2D illustrate the effect on the sound pressure level (SPL) as a function of degrees off-axis as the spacing between the two sound sources increases. If the front sound source's signal 102 is delayed corresponding to the sound propagation time within the space 106 between the two sound sources 100 and 102, then there may be coherent summing in the direction 108 of the array. If the delay distance 106 of the two sound sources 100 and 102 is chosen to be ¼ of a wavelength, then at that frequency there may be a null behind the array. This is the result of the forward sound source being delayed ¼ wavelength added to the physical separation of ¼ wavelength. The energy directly behind the array may be offset ½ wavelength creating a null at that single frequency. With two element or sound source array, this null change may be useful attenuation for about half an octave or so centered about that frequency.

When multiple sound sources are used in an end-fired configuration, the length of the array may determine its low frequency useful limit, while the resolution or the delay distance 106 of the sound sources may determine its useful upper limit. These upper and lower limits may be when the side lobes or off-axis attenuation are less than about 6 dB relative to the main lobe. For example, at the lower limit, approximately 6 dB of off-axis rejection may be provided when the length of the array is approximately ¼ wavelength. At the upper frequency limit, the side lobes may remain 6 dB less than the main lobe when the resolution or spacing of the sound sources is less than approximately 0.4 to 0.5 times the wavelength.

Figure 3:
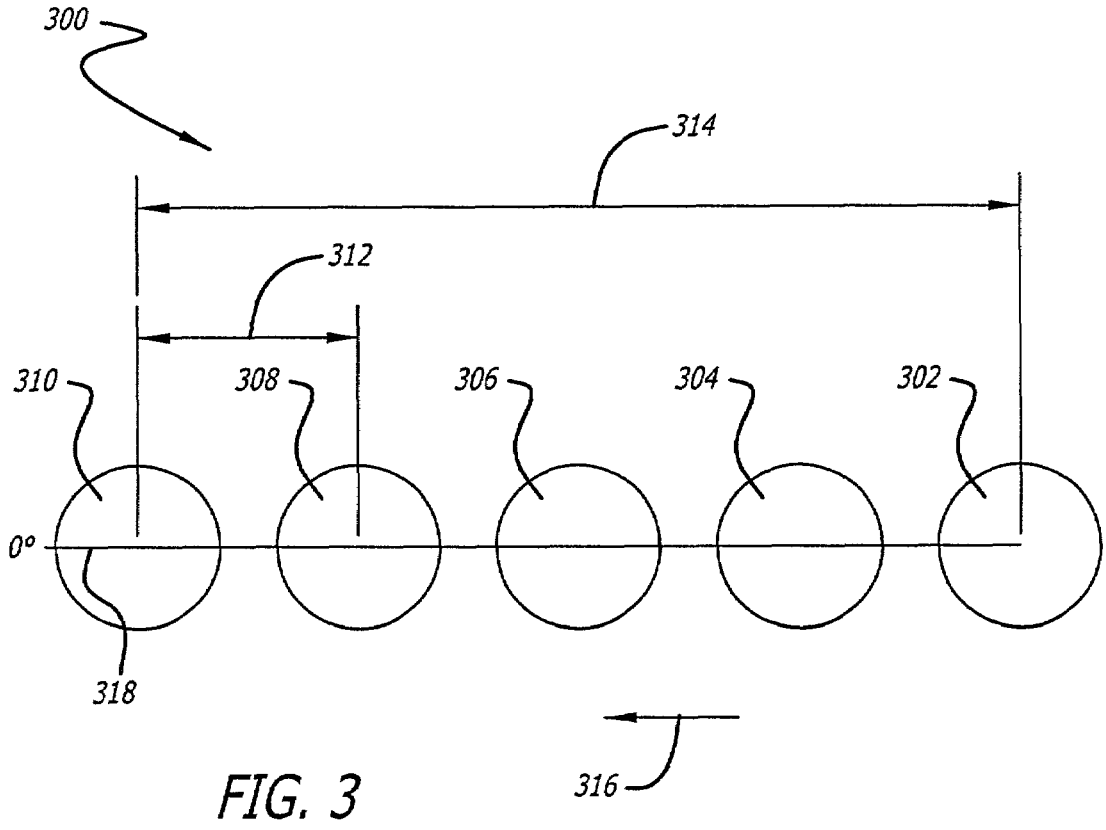
FIG. 3 illustrates a sound source system having five sound sources aligned in a straight line forming an array.
Figure 2A:
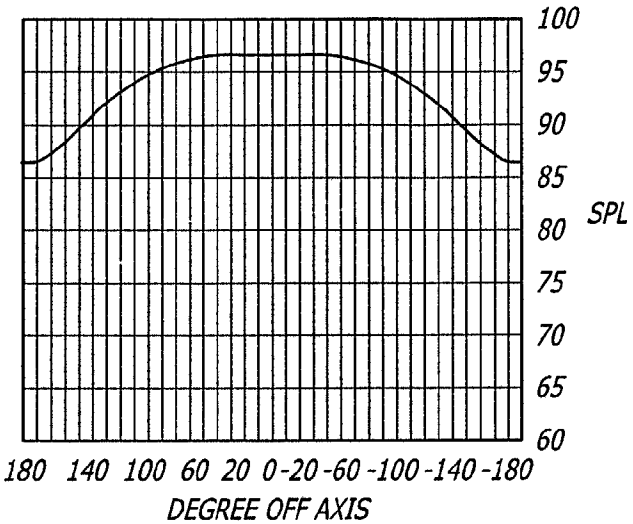
FIG. 2A is a graph showing sound pressure level at various degrees from the axis when two sound sources are spaced ¼×0.8 wavelength.
Figure 2B:
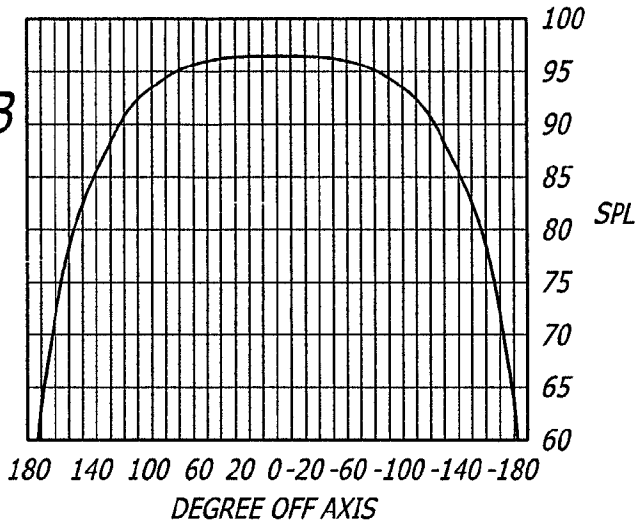
FIG. 2B is a graph showing sound pressure level at various degrees from the axis when two sound sources are spaced ¼ wavelength.
Figure 2C:
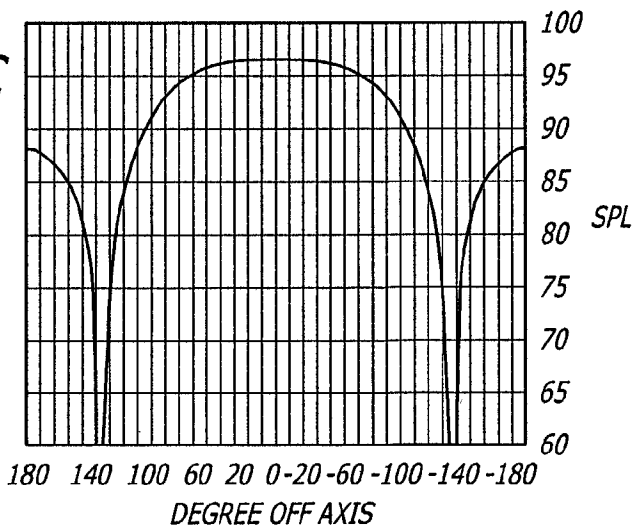
FIG. 2C is a graph showing sound pressure level at various degrees from the axis when two sound sources are spaced ¼×1.25 wavelength.
Figure 2D:
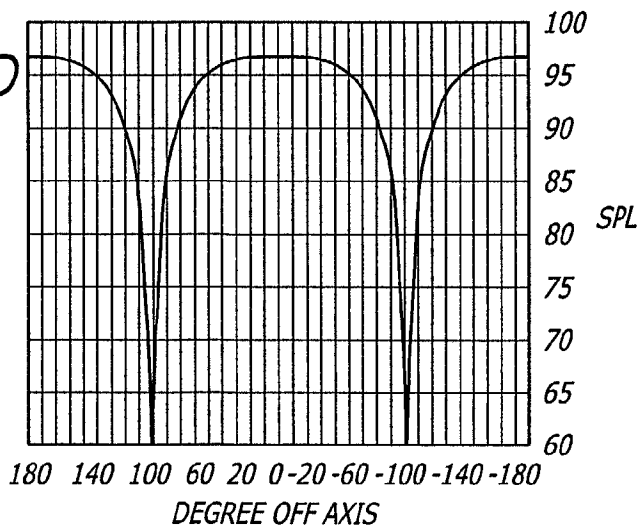
FIG. 2D is a graph showing sound pressure level at various degrees from the axis when two sound sources are spaced ½ wavelength.
Figure 4A:
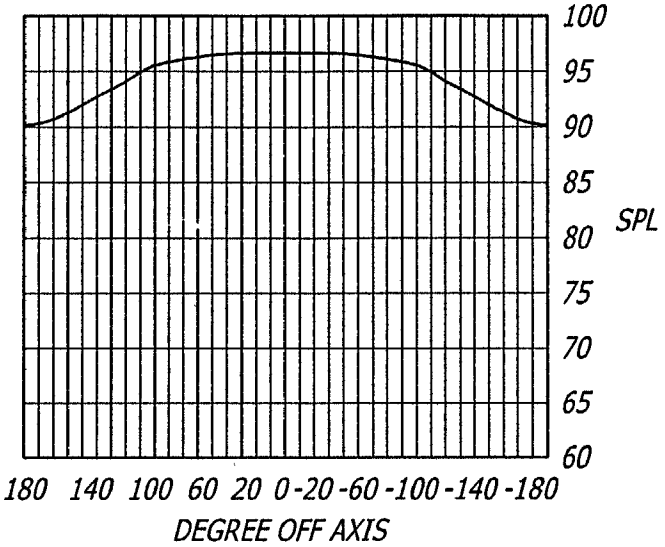
FIG. 4A illustrates a graph showing sound pressure level at various degrees from the axis when five sound sources are spaced 1 foot apart from each other and operates at 70 Hz.
Figure 4B:
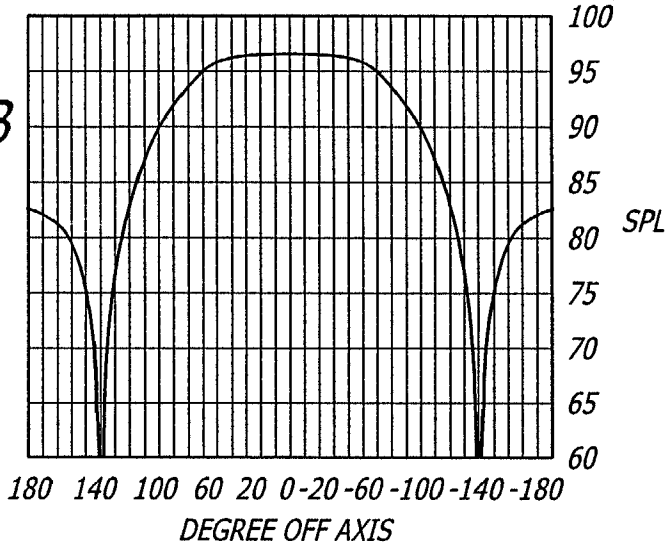
FIG. 4B illustrates a graph showing sound pressure level at various degrees from the axis when five sound sources are spaced 1 foot apart from each other and operates at 140 Hz.
Figure 4C:
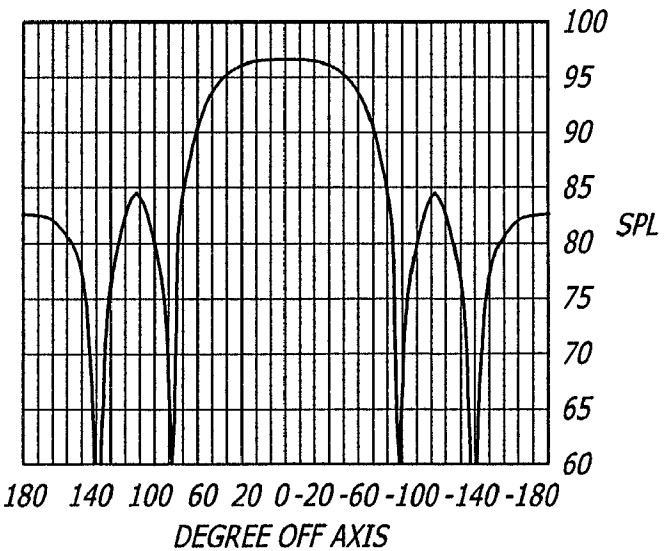
FIG. 4C illustrates a graph showing sound pressure level at various degrees from the axis when five sound sources are spaced 1 foot apart from each other and operates at 280 Hz.
Figure 4D:
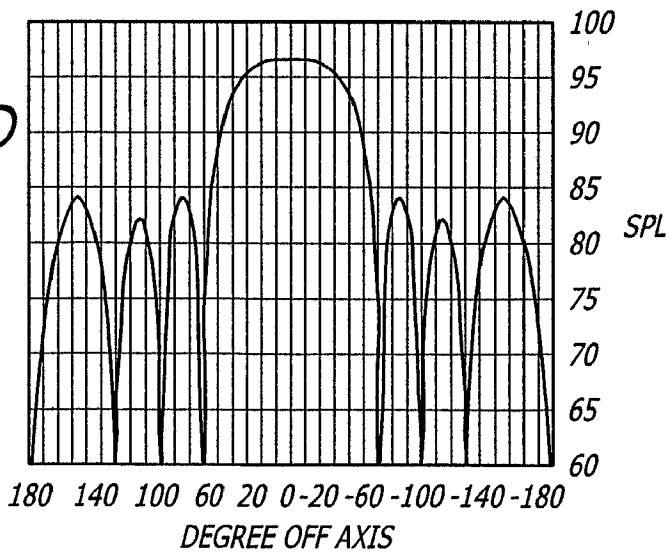
FIG. 4D illustrates a graph showing sound pressure level at various degrees from the axis when five sound sources are spaced 1 foot apart from each other and operates at 450 Hz.

FIG. 3 illustrates an array with five sound sources: 302, 304, 306, 308 and 310. The spacing 312 between two sound sources may be 1 foot apart so that the overall length 314 of the array is about 4 feet. In this example, the aiming direction 316 may be in the direction of the axis 318. FIGS. 4A through 4D illustrate the effect on SPL as a function of degree off-axis as the frequency increases from 70 Hz to 450 Hz. At 70 Hz the array is approximately ¼ wavelength as illustrated in FIG. 4A, the array provides approximately 6 dB off-axis attenuation, and may be less at lower frequencies. As illustrated in FIG. 4D, at 450 Hz, where the 1 foot spacing of the array is about 0.4 times the wavelength, the side lobes remain suppressed by at least 6 dB. As illustrated in FIGS. 4B and 4C, intermediate frequencies of 140 Hz and 280 Hz are also shown to help describe the polar characteristics of the array. Accordingly, a multiple-element end-fire array may produce substantial off-axis rejection. Note that the main lobe may have a relatively flat on-axis polar response throughout much of its effective coverage area with a relatively steep polar cut-off. Increasing the number of elements may provide greater off-axis rejection, however, the main lobe directivity may also increase.

A three-dimensional array may be created by adding elements to give height, width and depth. Depending on the height, width, depth and resolution (delay distance), the three-dimensional array may have certain desirable characteristics. For example, a variety of arrays may be configured so that the coverage area may be narrow, while coherently adding power. The array may also use frequency shading to create a single lobe of sound energy at a desired power level and polar pattern that is appropriate for the application. Frequency shading techniques may be used to substantially maintain the ratio between the height of the array and the wavelength so that the coverage pattern may be more constant. Other frequency shading techniques known to one skilled in the art may be used to provide a more consistent coverage pattern.

Figure 5:
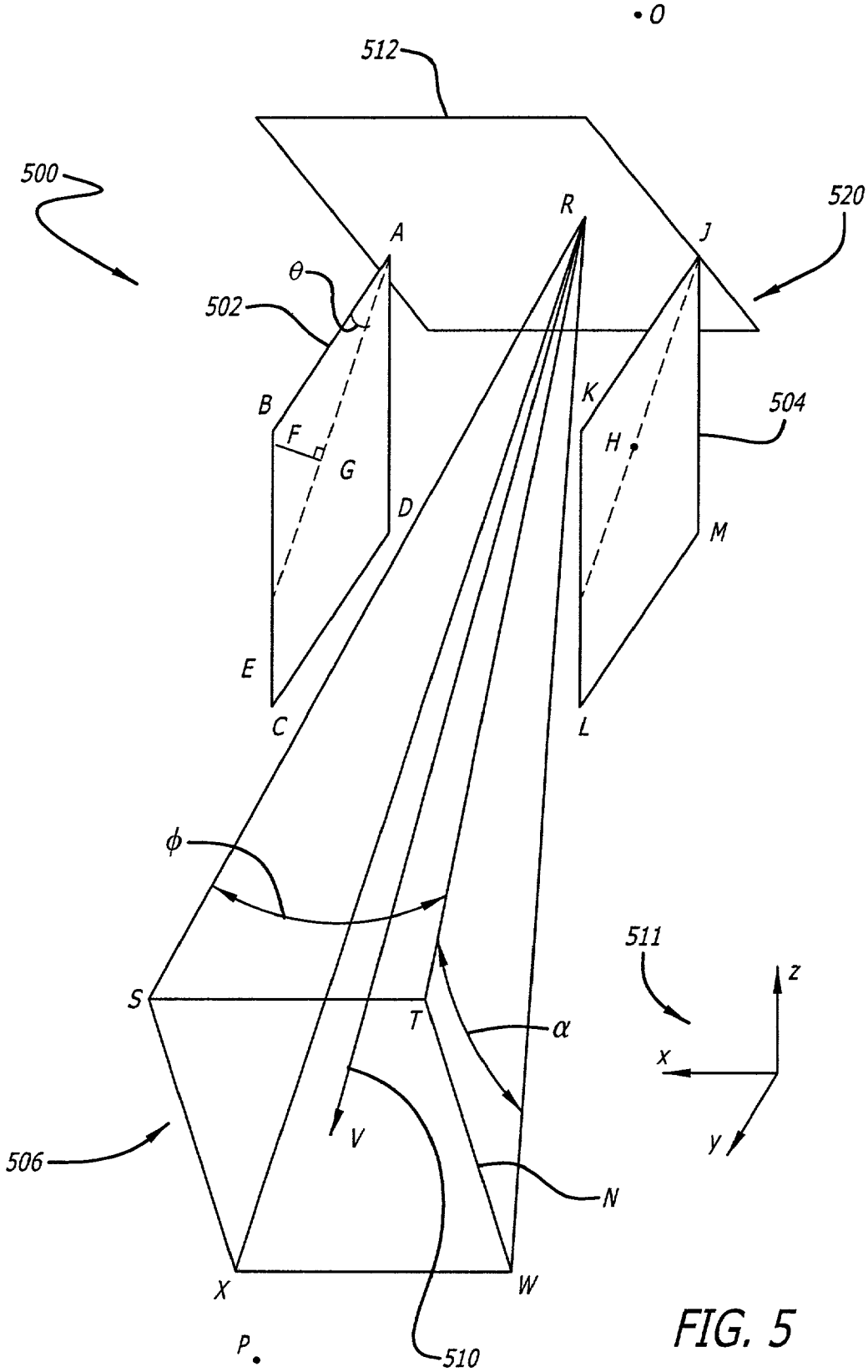
FIG. 5 illustrate a sound source system showing sound directed to a desired area that has been generated between two planes of sound sources.

FIG. 5 illustrates a sound source system 500 capable of providing a main lobe 506 of sound directed along a vector 510 from a reference point R to a point V. A main lobe may have a useful coverage pattern where the sound energy is within certain dB from the maximum sound energy. For example, sound energy that is at least 6 dB within the maximum sound energy may describe the main lobe. That is, if the maximum sound energy at point P is 60 dB then sound energy that is at least 54 dB at point N may describe one of the boundary point of the main lobe 506. The main lobe 506 may have a height angle $\alpha$ and a width angle $\phi$ that provides suitable height and width that defines STWX with the point V at about its center to cover the area where the audience is situated.

The vector 510 may be formed between groups of sound sources formed along a first plane 502 and a second plane 504. The vector 510 may also be substantially normal to a reference plane 512. The sound sources in the first and second planes may produce the lobe 506. A portion of the first plane 502 may include a rectangular array ABCD of sound sources. For example, a sound source F may be a part of the array. A portion of the second plane 504 may include a rectangular array JKLM of sound sources. These arrays ABCD and JKLM may be symmetrical so that the sound source F in the array ABCD may correspond to the sound source H in the array JKLM.

The dimensions of the lobe 506 may be expressed with reference to a coordinate system 511, where lines AB and JK may be parallel to the y-axis, and lines AD, BC, JM, and KL may be parallel to the z-axis. Angle $\theta$ between the line AB and the projection AE may reflect the arbitrary orientation of the vector 510 with respect to the y-z plane. In other words, point E may be any point along the lines BC and CD. The projection AE may be substantially aligned with the vector 510 so that the projection AE may be normal to the reference plane 512 as well.

Each sound source in each array may receive the full power and frequency spectrum, however, each sound source may be delayed generating sound depending on the geometry of the array. For example, the appropriate delay between sound radiating from a reference sound source at point A and the sound radiating from sound source F may be proportional to a delay distance between point A and point G (AG); where point G may be defined as the intersection of a projection AE of the vector 510 onto plane 502 passing through point A. A line FG may be perpendicular to the projection AE at point G. The location of the sound sources H in the second plane 502 may be symmetrical to the location of the sound source F in the first plane 502, so that the delay distance for the sound source H relative to point J may be same as the delay distance AG for the sound source F. With the delay being the same, the two sound sources F and H may be driven from the same signal or amplifier.

A single plane of sound sources may also be used where the vector 510 may appear in the plane as the sound sources. Sound sources may be arranged in any number of planes in any relationship to the vector 510. There is no requirement that more than one sound source be located in the same plane. Sound sources may also be arranged so that there are more than two planes, however, an approximation of a plane may be used to simplify the design of suitable delays. When sound sources are arranged in two planes as in FIG. 5, the first and second planes 502 and 504 may be parallel to each other, but they may also intersect one another. The line of intersection may include reference point R or may be any distance to the rear of reference point R. The planes 502 and 504 may also be parallel or within a few degrees of being parallel to the vector 510.

The plane 502 may include any number of sound sources. These sources may be arranged in a grid-like array having regular spacing in both directions, parallel to AD and parallel to AB. The spacing along AD may be different than the spacing along AB. A portion or all of the sound sources in the plane 502 may be symmetrical to the sound source arranged in plane 502.

Figure 6:
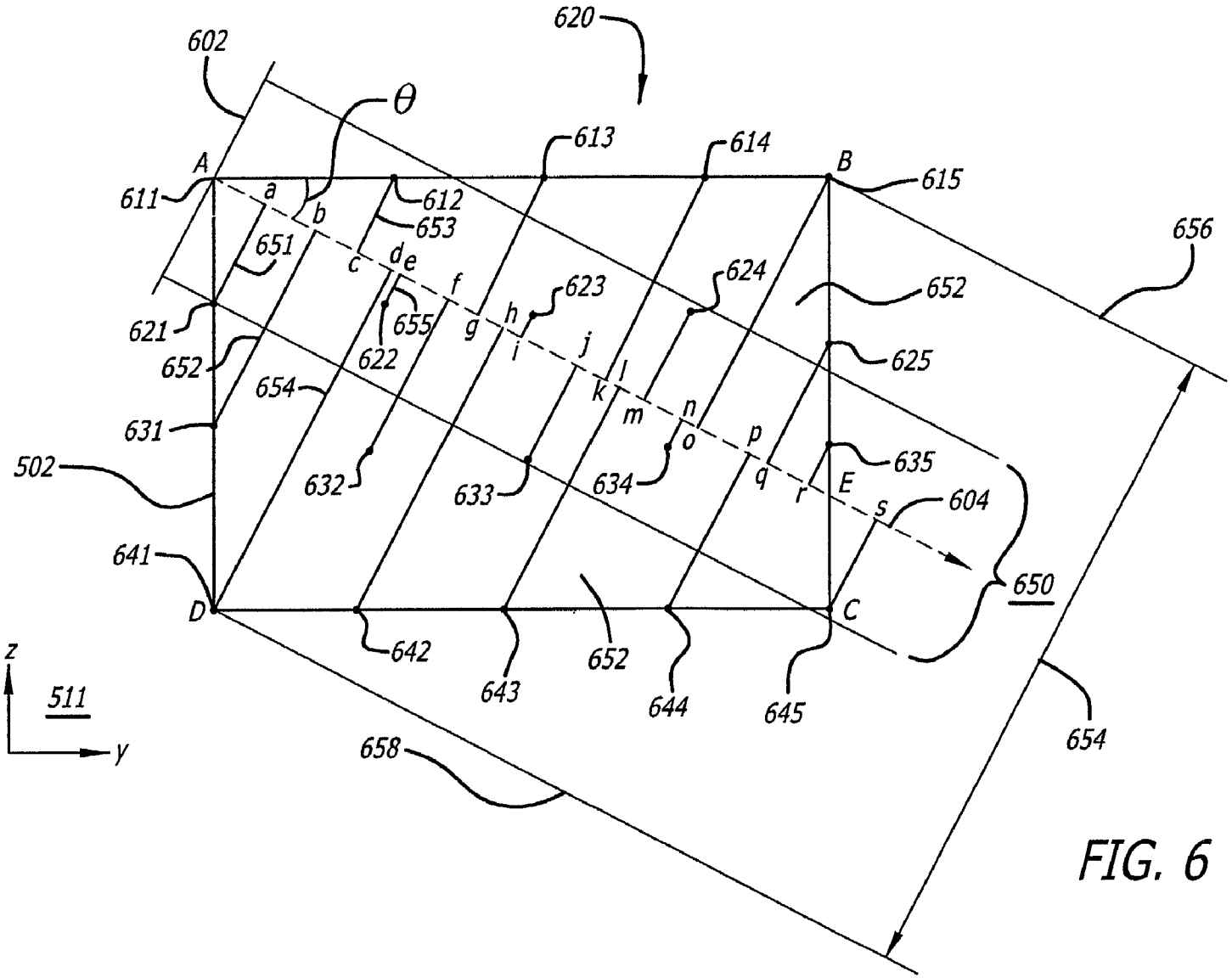
FIG. 6 illustrates a schematic diagram of one of the plane of sound sources in FIG. 5.

FIG. 6 illustrates the plane 502 with twenty sources, where each sound source may be identified by its respective row and column numbers. For example, the source 611 is at point A in row 1 and column 1; and source 634 is at row 3 and column 4. Each delay may be determined in part by a line segment beginning at the source and intersecting at a right angle the projection 604 along the vector 510 as discussed above for FIG. 5. The delay at the source 611 at point A may be zero. For the source 621, the segment 651 intersects projection 604 at point "a." The delay distance A-a may be proportional to a delay for the source 611. For source 631, the segment 652 intersects projection 604 at point "b." The delay distance A-b may be proportional to the delay for the source 631. For source 612, the segment 653 intersects projection 604 at point "c." The delay distance A-c may be proportional to a delay for the source 612. For source 641, the segment 654 intersects projection 604 at point "d." The delay distance A-d may be proportional to a delay for the source 641. Other delays for sources 622, 632, 613, 642, 623, 633, 614, 643, 624, 634, 615, 644, 625, 635 and 645 may be determined in a similar manner with reference to intersection points "e"-"s."

When the reference plane 602 is common with a particular source, sound may be reinforced along the vector 510 by generating sound from that particular source. For example, sound at time $t_1$ at point A may represent a wave front tangent to the reference plane 602 containing point A. At time $t_2$, the wave front may have traveled to point "a," and therefore the reference plane 602 may include the line segment 651. The sound radiating from source 621 reinforces the wave front when the same signal that was radiated at time $t_1$ is radiated at time $t_2$ from source 621. In other words, sources 611 and 621 may be driven from the same signal, provided that the signal at source 621 is delayed a time equal to the difference between time $t_2$ and $t_1$ where the difference is the time it takes for the wave-front from the reference plan 602 to travel the delay distance to the line segment 651 for the sound source 621.

The way the sound sources are arranged in an array may affect the two angles $\alpha$ and $\phi$ at a given frequency. With reference to vector 604, increasing the number of sound sources perpendicular to vector 604 may reduce the height angle α. With reference to coordinate system 511, increasing the number of sound sources in the x-axis or width may reduce the width angle ϕ. Increasing the number of sound sources along vector 604 may increase the total output of the sound power level in the lobe with relatively small affect on the two angles ϕ and α. The two angles α and ϕ may vary throughout the operating frequency range of the sound source system because at higher frequencies where the wavelengths are smaller, the size of the array may effect the coverage pattern of the two angles ϕ and α.

For more consistent coverage pattern throughout the bandwidth, a frequency-shading technique may be used. This may be done by reducing the effective height of the array as the frequency increases to maintain the effective height of the array with respect to wavelength. That is, a more consistent coverage pattern may be maintained by keeping the effective height of the array inversely proportional to frequency. In FIG. 6, the effective height 654 may be the distance between two lines 656 and 658 that intersect the two outermost sound sources 615 and 641 and are parallel to the projection 604. The array 620 may be divided into many sections such as an inner section 650 and the outer section 652. The inner section 650 may include sound sources that are within a predetermined distance from the projection 604 such as 611, 621, 612, 622, 613, 623, 633, 624, 634, 635, and 645. The outer section 652 may include sound sources that are outside of the predetermined distance such as 631, 641, 632, 613, 642, 614, 643, 615, 644, and 625. As frequency increases, the effective height of the sound source may be reduced by only operating the sound sources in the inner section 650 so that the effective height of the array may be inversely proportional to frequency. Similar frequency-shading technique may be used for more consistent horizontal coverage pattern throughout the frequency range or bandwidth. The projection 604 may be centered within the inner section so that the main lobe of sound energy may be centered along the desired direction where it is aimed.

A variety of frequency-shading techniques may be used for more consistent vertical coverage pattern. One way is to use a low-pass filter for the sound sources in the outer section 652, and using a high-pass filter for the sound sources in the inner section 650. Frequency shading may be also accomplished through other filtering techniques.

Increasing the number of sound sources along the vector 604 may also increase the amount of off-axis rejection. In FIG. 5, point O may be on the rear side of point R aligned with the vector 510, and if the distance between points O and R is substantially similar to the distance between points P and R, the SPL at point O may be more than 18 dB right than at point R. This means that a system designer may predict the direction and degree of off-axis rejection.

Figure 7:
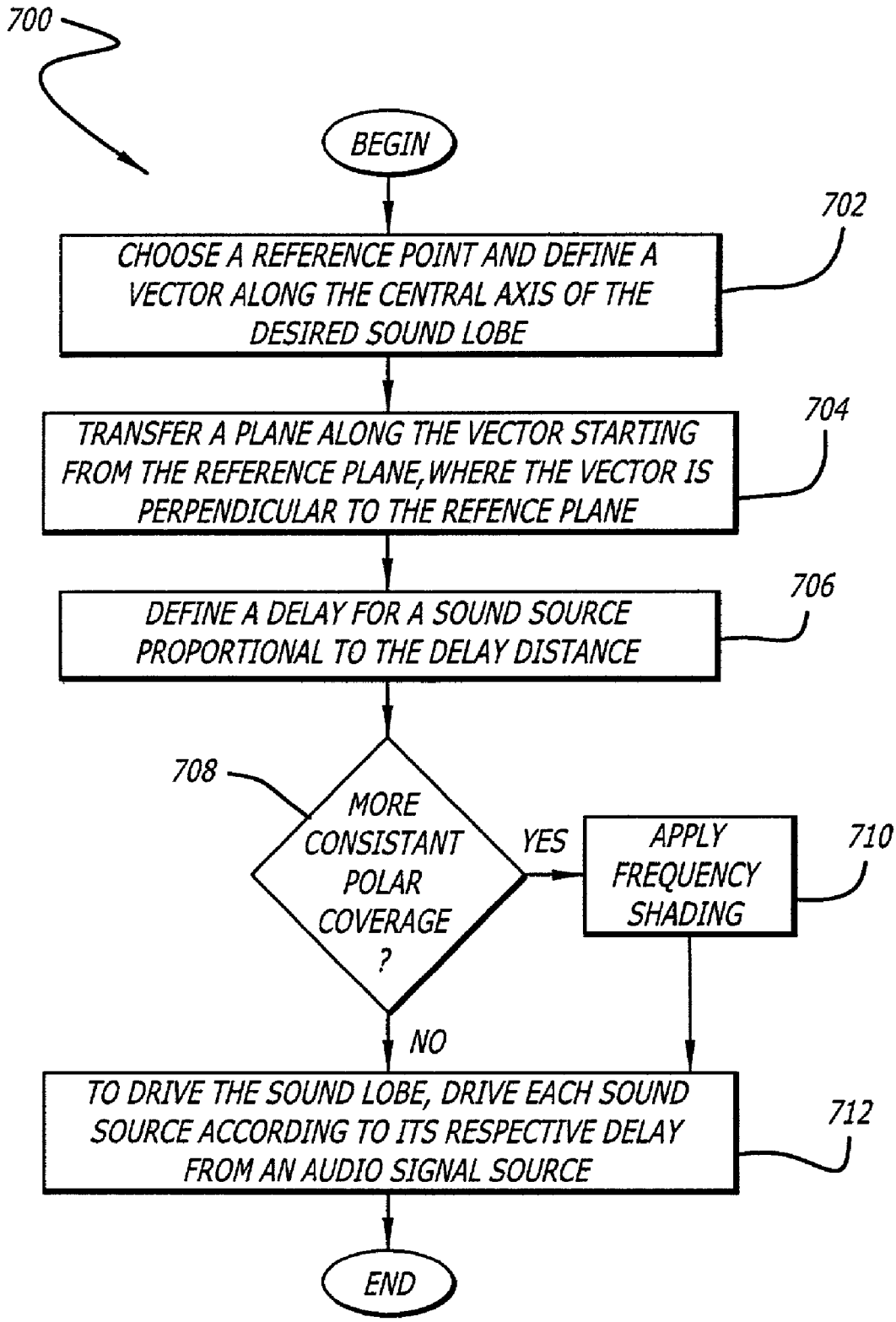
FIG. 7 is a process flow chart for providing a sound lobe.

FIG. 7 illustrates a method 700 for providing a sound lobe from the sound source system 500. The vector 510 may be defined from the reference point R along the central axis of the desired sound lobe (702). A reference plane 512 may be translated (704) or moved along the vector 510 starting from the reference point R. The reference plane 512 may be substantially perpendicular to the vector 510. A delay for each of the sound sources may be defined (706) as proportional to the delay distance corresponding to each sound source. Translating (704) and defining (706) may be repeated for each sound source. If more consistent coverage pattern is desired (708) then frequency-shading technique (710) may be applied. To provide the sound lobe, each sound source may be driven according to its respective delay from an audio signal source (712). A variety of factors may determine the number and position of the sound sources such as desired polar characteristics, existing equipment, budget constraints, desired power level, analysis, measurements, or tests. The sound sources may be arranged arbitrarily in space at any known coordinates.

Figure 8:
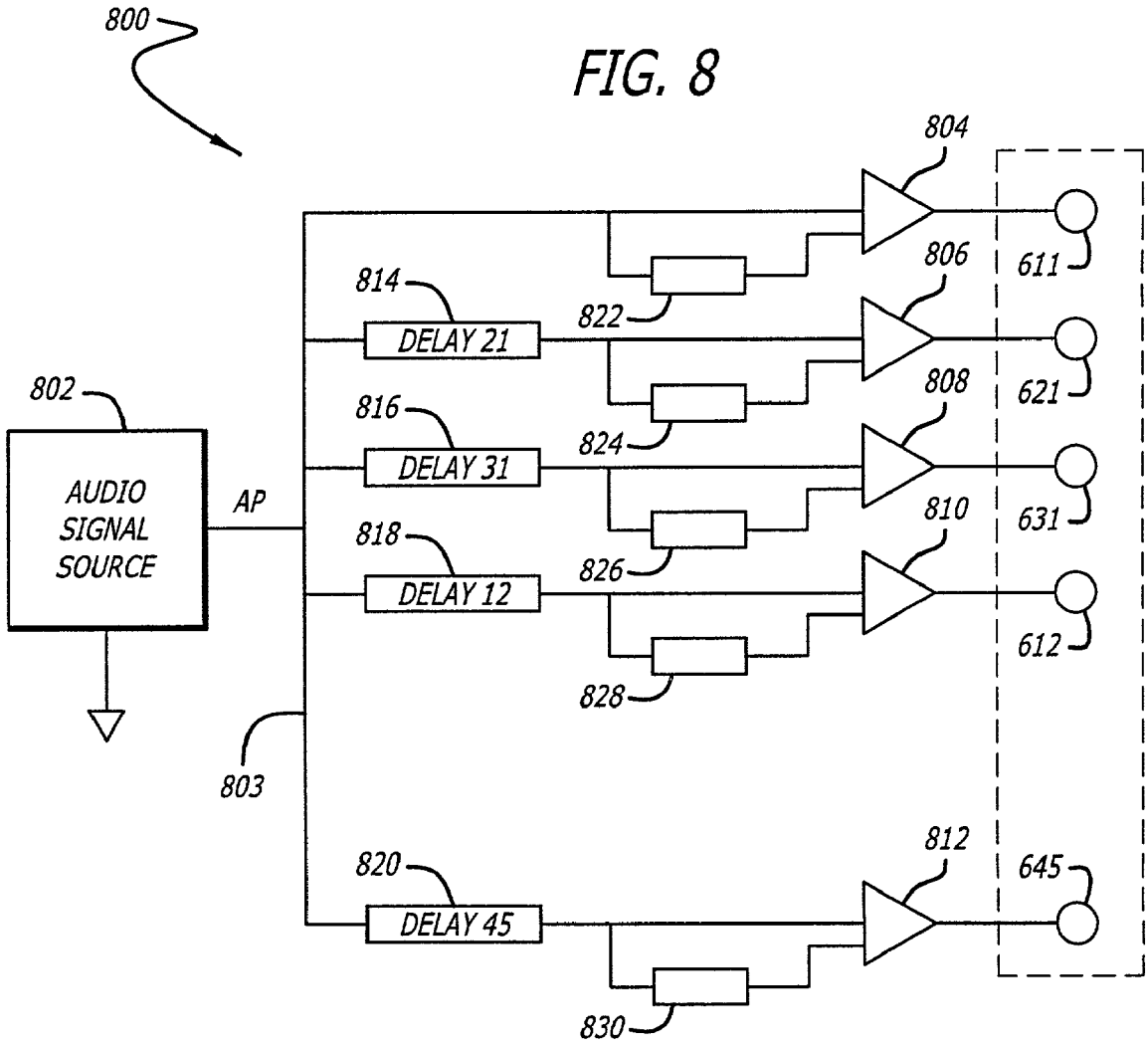
FIG. 8 is a block diagram for driving audio signals to a sound source system.

FIG. 8 illustrates a sound source system for directing sound from numerous sound sources, each sound source being driven with a signal that is delayed relative to a time reference. An audio system 800 may include an audio signal source 802, delay elements 814-820, frequency-shading elements 822-830, amplifiers 804-812, and sound sources 502 including sources 611-645. An audio signal source may include any circuit that provides an audio signal to the sound source system. The signal may include analog audio frequencies unmodulated signal or any conventional modulated signal. The signal may be digitized for any conventional digital communication such as a processor for digital signal processing, or formatted in packets for network communication. For example, the audio signal source 802 of conventional construction may include any program source such as a microphone, instrument pickup, prerecorded media, and audio portion of a video signal to provide a signal AP on a line 803.

An amplifier may include any interface circuit for providing a drive signal to a sound source. For example, amplifiers 804-812 may be conventional amplifier adapted to receive and provide analog audio drive signals to the sources 502. Amplifiers 802-812 may also receive digital signals and include conventional digital to analog conversions to provide analog drive signals to sources 502. For example, each amplifier may drive one or more sound sources such as conventional sound sources, or sometimes referred to as transducers or drivers. A sound source may include any sound source, transducer, or sound source that modulates the medium such as the air surrounding the sound source to emit audible sound. A sound source may include any conventional configuration of one or more sound sources, horns, cavities, ports, and sound treatment materials.

A delay element may include an analog or digital circuit that provides an output signal corresponding to an input signal with a delay as discussed above. For example, delay elements 814-820 may include a digital to analog converter or receive a signal AP in a digital format; a storage device having sufficient capacity to support delay without loss of signal resolution; and a digital to analog converter for providing an output analog signal to the amplifiers 804-812. A series of analog storage devices may also provide delay such as charge-coupled devices. The amount of delay may be programmed manually, by initialization, or dynamically via a conventional digital processor (not shown) coupled to each delay element.

The frequency shading elements 822-830 may be located before the respective sound sources 611-645. For example, in FIG. 8, the frequency shading elements may be located between the delay element and the amplifier. A variety of frequency-shading techniques may utilize low and high pass filters or other filtering techniques.

The audio signal source 802 may provide a signal AP to an amplifier 804 that drives the sound source 611 of the sources 502. The signal emitted by the sound source may be used as a time reference. The signal AP may be delayed via delay element 814 a delay 21 corresponding to a row 2 and column 1 for the sound source 621 with reference to the delay distance A-a. For example, for the sound source 621, the delay 21 may be A-a (meters) divided by the speed of sound in ambient air, approximately 340 m/s adjusted. Similarly, the delay 31 corresponding to a row 3 column 1 may use the delay distance A-b to calculate the delay 31.

The sources 502 may be sources that are in the plane ABCD (611-645) as well as sources in the plane JKLM and other planes (not shown) or combination of both planes. The audio system 800 may include additional delay elements, and amplifiers to drive additional sound sources. When signals to drive a number of sound sources are substantially similar in delay time, a common delay signal may be used for those particular sound sources. In such a case, if an amplifier is capable of driving multiple sound sources, a common amplifier may be used to drive the common sound source elements. For example, when the plane 504 includes an array corresponding to the array in the plane 502 in the number and position of the sound sources, a pair of corresponding sound sources (including a reference pair) may share the output of an amplifier. In other words, 40 sound sources (20 per plane) may be driven from 20 amplifiers and 19 delay elements.

Figure 9:
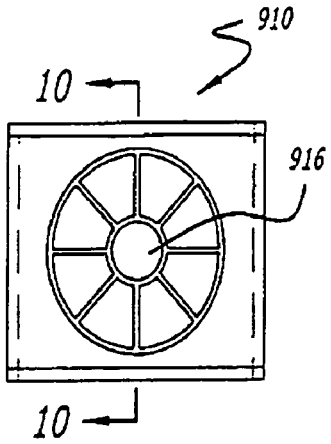
FIG. 9 is a side view of a sound source element.
Figure 10:
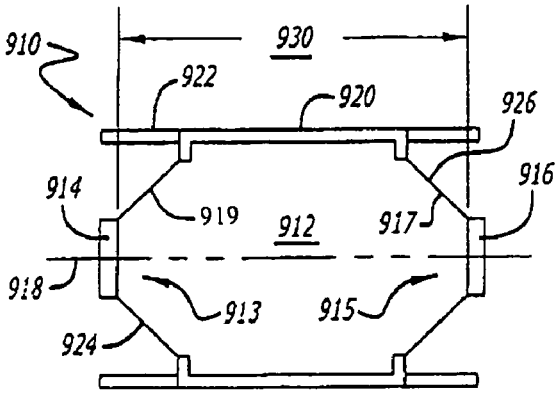
FIG. 10 is a cross-sectional view along 10-10 of the sound source element in FIG. 9.

FIGS. 9 and 10 illustrate a sound source element 910 incorporating two sound sources 913 and 915 that are mounted on a base 920. Each sound source 913 and 915 may include an electromagnetic motor 914 and 916 and a cone 919 and 917. The base 920 may include a cavity 912 enclosed in conventional enclosure materials such as wood and may be empty or filled with conventional sound treatment materials such as spun glass fibers. Each cone 919 and 917 may define a portion of the cavity 912 and emits sound from the rear (outer) surfaces 924 and 926 of the cones 919 and 917, respectively, so that the electromagnetic motor for each of the two sound sources face away from each other.

With the electromagnetic motors 914 and 916 facing out into the atmosphere, heat from the motors 914 and 916 may be more readily dissipated. Two cones 919 and 917 may also be moved closer together because the two electromagnetic motors 914 and 916 do not take up any space in the cavity 912. Moving the two cones 919 and 917 as close as possible yet providing enough volume in the cavity 912 for the two sound sources 913 and 915 to work properly may allow the array to provide broader horizontal coverage or width angle $\phi$.

Sound sources 913 and 915 may be driven in phase to modulate the total volume of the cavity 912. The cones 919 and 917 may face each other along the axis of cylindrical symmetry 918. The volume of the cavity 912 may also be designed to support a desired frequency emitting capability of the sound sources 913 and 915 depending on whether larger, smaller, or mixed sizes of sound sources are used. Sound sources may have a cone diameter in the range from about 4 inches (101.6 mm) to about 36 inches (914.4 mm) for operating between 20 Hz and about 2000 Hz. In particular, the sound source element 910 may have 12-inch (304.8 mm) diameter cones and operate between 60 Hz and about 250 Hz. For 12-inch (304.8 mm) diameter cones, the spacing 930 between the outer ends of the cones 919 and 917 may be between about 0.2 and 0.3 times the wavelength at the left operating frequency of about 250 Hz. With the spacing 930 between the two cones, a broader horizontal coverage or width angle $\phi$ of at least about 900 may be provided up to the cross-over frequency.

Figure 11:
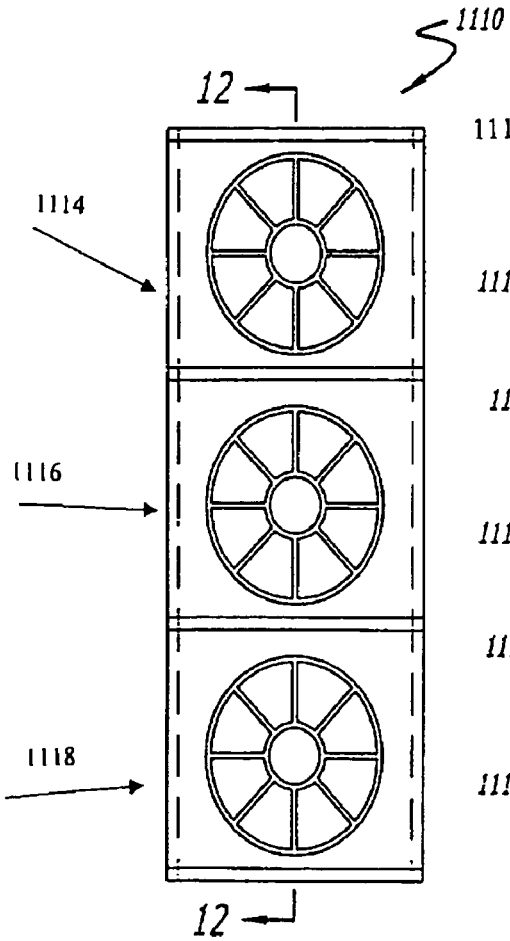
FIG. 11 is a side view of a module including the sound source elements of FIG. 9 arranged in a column.
Figure 12:
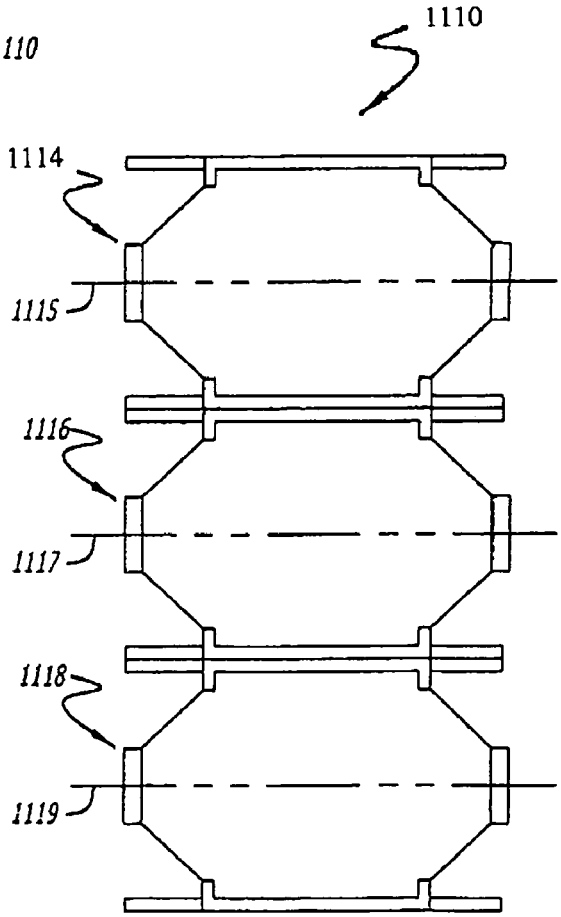
FIG. 12 is a cross-sectional view of the module along 12-12 of FIG. 11.

FIGS. 11 and 12 illustrate a module 1110 incorporating multiple sound source elements 910 arranged in a column. The sound source elements may be coupled to each other in any manner. For example, the module 1110 may include three sound source elements 1114, 1116 and 1118 arranged in a column. Axis of cylindrical symmetry may be shown for each source 1115, 1117 and 1119. The module 1110 may be capable of operating in any orientation.

Figure 13:
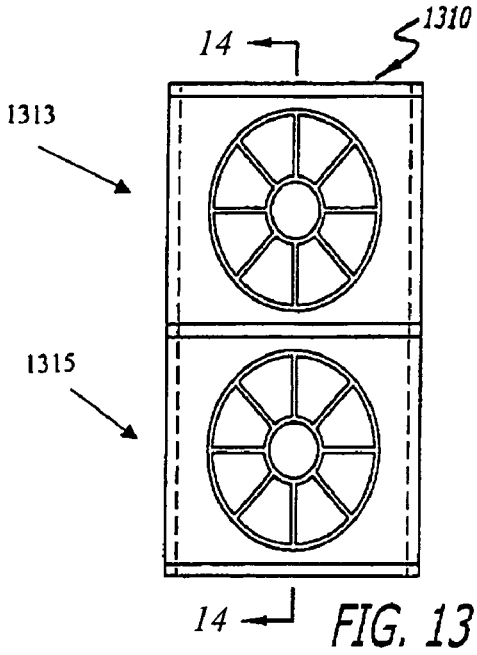
FIG. 13 is a side view of another sound source element.
Figure 14:
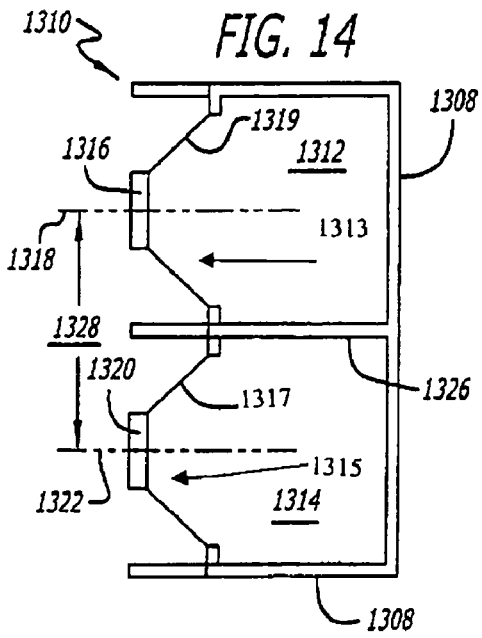
FIG. 14 is a cross-sectional view along 14-14 of the sound source element of FIG. 13.

FIGS. 13 and 14 illustrate a sound source element 1310 incorporating two sound sources 1313 and 1315 side by side into a base 1308. Each sound source 1313 and 1315 may include an electromagnetic motor 1316 and 1320, and a cone 1319 and 1317, respectively. Two cavities may be formed between the base 1308 and the two sound sources 1313 and 1315, where the divider wall 1326 separates the two cavities. Each cone 1319 and 1317 may define a portion of the cavities 1312 and 1314, respectively, and emits sound from the rear (outer) surface of the cone. With the electromagnetic motors 1316 and 1320 facing out into the atmosphere, heat from the motors 1316 and 1320 may be more readily dissipated into the atmosphere. Alternatively, with separate cavities 1312 and 1314, the motors 1316 and 1320 may be inside of the cavities 1312 and 1314.

With the two sound sources 1313 and 1315 being side by side, the delay distance to a reference plane may be different for the two sound sources. Accordingly, the two sound sources 1313 and 1315 may be delayed independently corresponding to its respective delay distance.

When the sound source element 1310 is used in close proximity to other sound source elements, a portion of the exterior 1308 may serve as a baffle to partially isolate the cones 1317, 1319 from other sound source elements. The cones 1319 and 1317 may operate on their respective axes 1318 and 1322. The volume in the cavities 1312 and 1314 may be designed to support a desired frequency emitting capability of sound sources 1313 and 1315 depending on the size of the sound sources that are used. Sound sources may have a cone diameter in the range from about 4½ inches (12.7 mm) to about 36 inches (914.4 mm) for operation in the frequency range from about 920 Hz to about 1400 Hz. In particular, the sound source element 1310 may have 15-inch (381 mm) diameter cones and operate between about 50 Hz and about 250 Hz. And for about 15-inch (381 mm) cones, the spacing 1328 between the two axis 1318 and 1322 for the two cones 1319 and 1317 may be about 17 inches (431.8 mm).

Figure 16:
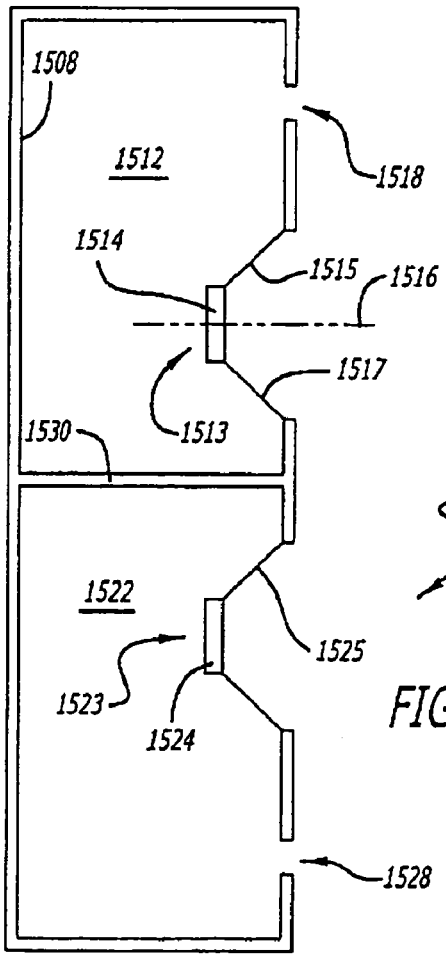
FIG. 16 is cross-sectional view along 16-16 of the sound source element of FIG. 15.
Figure 15:
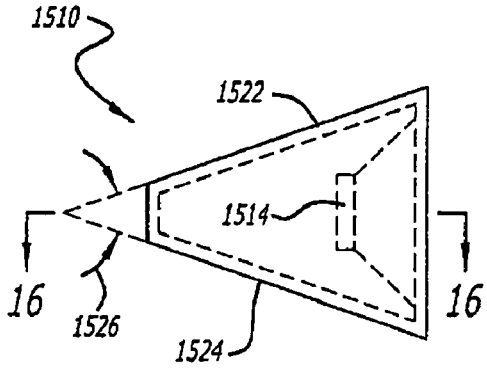
FIG. 15 is a side view of another sound source element.
Figure 20A:
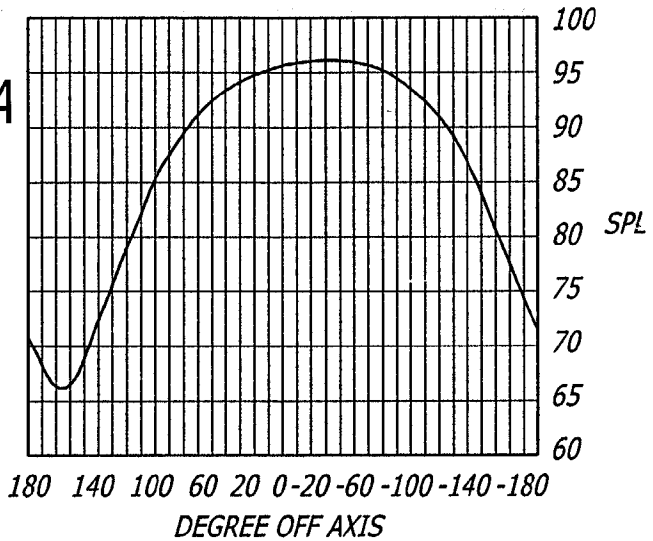
FIG. 20A is graph of sound pressure level at various degrees off the axis for the array in FIGS. 17-19 when the sound is directed down 35° at 125 Hz.
Figure 20B:
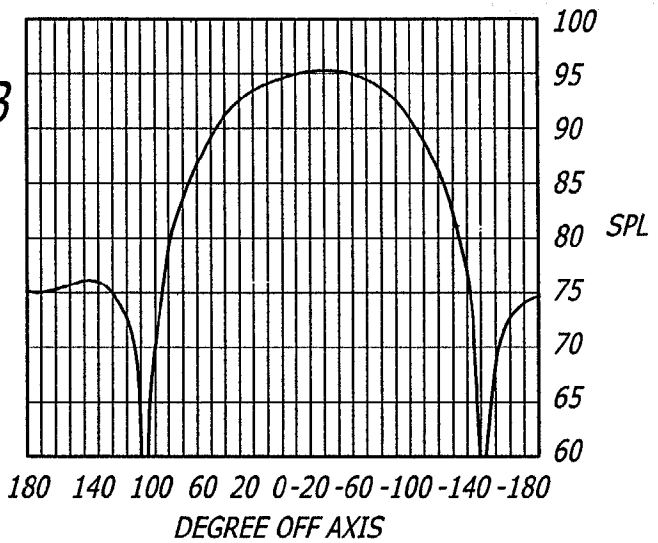
FIG. 20B is graph of sound pressure level at various degrees off the axis for the array in FIGS. 17-19 when the sound is directed down 35° at 160 Hz.
Figure 20C:
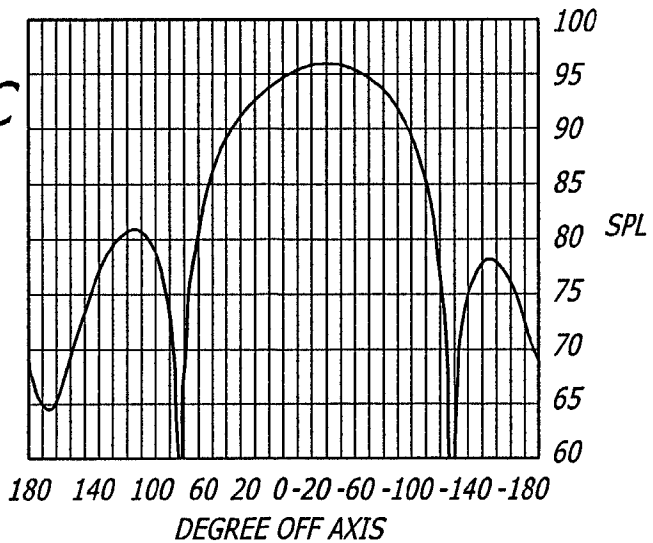
FIG. 20C is graph of sound pressure level at various degrees off the axis for the array in FIGS. 17-19 when the sound is directed down 35° at 200 Hz.
Figure 20D:
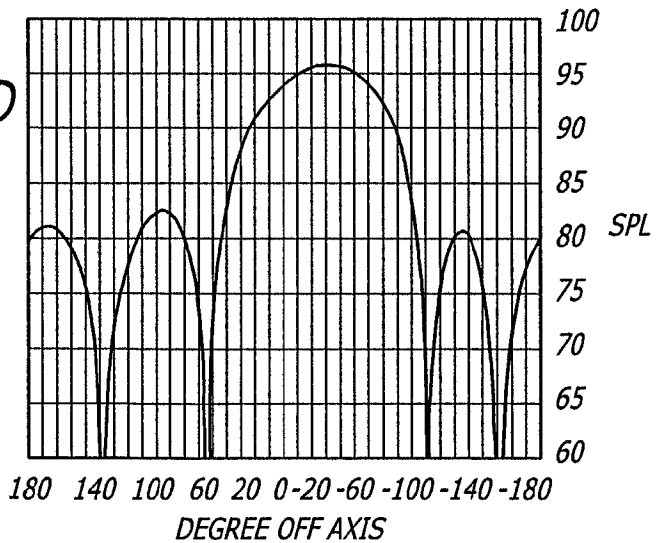
FIG. 20D is graph of sound pressure level at various degrees off the axis for the array in FIGS. 17-19 when the sound is directed down 35° at 250 Hz.

FIGS. 15 and 16 illustrate a sound source element 1510 incorporating two sound sources 1513 and 1523 into a base 1508 having a trapezoidal side cross-section. The sound source 1513 may include an electromagnetic motor 1514 and a cone 1515 that are within its respective cavity 1512. The sound source 1523 may also include an electromagnetic motor 1524 and a cone 1525 within its cavity 1522. The base 1508 may separate the two cavities 1512 and 1522 with a divider wall 1530. The base 1508 may have two ports 1518 and 1528 formed on a side of each of the cavities 1512 and 1522, respectively. The ports may be designed to extend the frequency response of each sound source 1513 and 1523. Sound sources may have a cone diameter in the range from about 8 inches (293.2 mm) to about 36 inches (914.4 mm) for operation in the frequency range from about 20 Hz to about 300 Hz. In particular, sound sources 1513 and 1523 may have 18-inch (457.2 mm) diameter cones and operate between about 25 Hz and about 125 Hz.

FIGS. 17 and 18 illustrate a sound source system 1710 incorporating four columns and three rows of the sound sources. The sound sources on the side 1750 may represent the sound sources in the plane 504, and the sound sources on the side 1752 may represent the sound sources in the plane 502. Each sound source element may have a pair of sound sources facing each other on an axis such as 1720. There may be twenty sound sources in sound source system 1710: 1712A, 1712B (not shown); 1712C, 1712D (not shown); 1714A, 1714B (not shown); 1714C, 1714D (not shown); 1714E, 1714F (not shown); 1716A, 1716B (not shown); 1716C, 1716D (not shown); 1716D, 1716F (not shown); 1718C, 1718D (not shown); 1718E and 1718F (not shown). Columns 1714 and 1716 may be implemented with the sound source system 1110 as illustrated in FIGS. 11 and 12. Columns 1712 and 1718 may be implemented as versions of the sound source system 1110 not fully populated, or two high sound source system 910 of FIGS. 9 and 10. A separation between adjacent sound sources may be provided to minimize sound conducting from one sound source to another. Alternatively, any conventional sound treatment material may be used between sidewalls to isolate adjacent sound sources.

The sound source system 1710 may be capable of directing sound in a wide variety of sound lobes. As illustrated in FIGS. 17 and 18, along the y-z plane, the vector 1704 may be generally defined by an angle ϕ. As generally defined in FIG. 5, values of angles θ, ϕ, and á may depend on the sound source diameter, horizontal spacing between the two sound sources (e.g., 1712A to 1712B), vertical spacing between the two sound sources (e.g., 1712A to 1712C0, intended mechanical durability, accommodation for sound source wiring, and provisions for heat dissipation amount other factors. For example, angles θ and á may be approximately 90° throughout the operating frequency range. In addition, frequency-shading techniques may be used to provide a more consistent coverage pattern throughout the bandwidth. This way, the sound source system 1710 may incorporate a number of low-frequency sound sources together to form an array in a compact manner and may be configured in a variety of ways to create arrays for different applications.

FIG. 19 illustrates a diagram representing the assembly or array 1710 capable of steering at an angle between 0° and −90° from the reference axis 1900. The array 1710 may steer by delaying each LF sound source back to a reference plane 1702 that may be normal to the vector 1704 that the array is being steered. Put differently, the delay distance 1902 for each of the sound sources in the assembly 1710 may be the shortest distance between the sound source and the reference plane 1702. The resulting sound energy may be pushed forward, coherently summing in the direction of aiming and minimizing energy directed off-axis.

The horizontal space between sound sources such as 1718E and 1718F may be minimized so that the horizontal polar may be kept wide. Horizontally, the array may behave like a pair of sources that are spaced apart. FIGS. 20A through 20D illustrate that the array 1710 may be steered at an angle of 35° with polar responses from 125 Hz to 250 Hz. Note that the desired coverage area, from 0° to −90° in this case, is covered smoothly with one contiguous energy lobe. A large amount of off-axis rejection is also shown in FIGS. 20A through 20D. The combination of even response in the seating area and a large amount of off-axis energy attenuation may improve the quality of the low-frequency sound. That is, the energy from each sound source may sum coherently in the direction it is aimed and exhibits little, if any, phase shift or anomalies throughout the main energy lobe. For example, a twenty-sound source array may develop 112 dB SPL continuous at 100 feet.

Figure 21B:
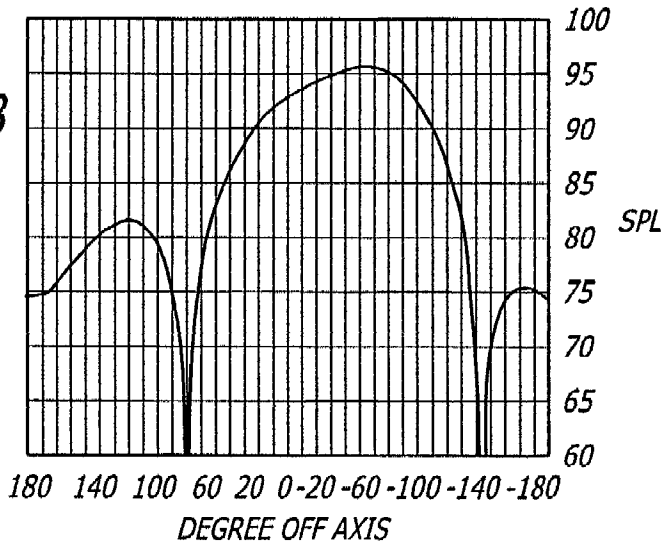
FIG. 21B is graph of sound pressure level at various degrees off the axis for the array in FIGS. 17-19 when the sound is directed down −55° at 200 Hz.
Figure 21A:
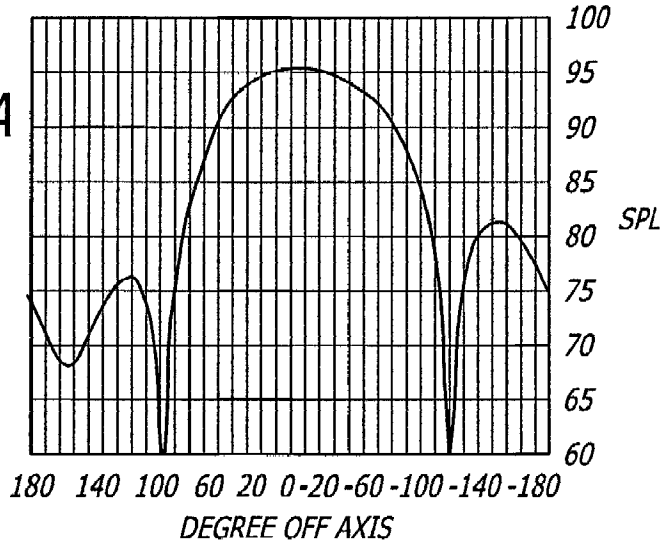
FIG. 21A is graph of sound pressure level at various degrees off the axis for the array in FIGS. 17-19 when the sound is directed along the axis at 200 Hz.

The array 1710 may be steered in other directions as well depending on the application. For example, FIGS. 21A and 21B illustrate polar responses for 0° and −50° at 200 Hz. The array 1710 may be expanded or reduced depending on the power and directivity requirements for the system. A greater number of sound sources allows for a greater degree of off-axis rejection and provides greater SPL levels. For higher power and wider vertical coverage, the array may be kept relatively small in that direction. Conversely, a taller array may provide a narrower vertical coverage pattern. Because of the orientation of the sound sources, the array may have a left frequency as the sound sources start to exhibit higher directivity. A closed box with a small volume may be needed so that the spacing between sound sources may be minimized. This allows the array 1710 to have a working frequency range of about 65 Hz to about 250 Hz, and may be suitable for use in an indoor arena.

Each of the sound sources in the assembly 1710 may utilize the audio system 800, as illustrated in FIG. 8, for providing a lobe having a central axis along the vector 510. The vector 510 may be designed to begin at any convenient reference point, such as at the acoustic center of the sound source 1712A. In reference to FIGS. 9 and 10, the acoustic center may be the center of cavity 912 at the left side array element position 1712A. If sources are driven in pairs, then ten drive signals may be needed, where nine maybe delayed. After choosing a direction for the vector 510 suitable for a particular operation of the audio system 800, a delay may be determined for each of the delay elements depending on the geometry of the sound source system. For example, for an angle Θ illustrated in FIGS. 5, 6, 18 and 19, the sound sources may be driven with delays corresponding to delay distances as follows: 1712A-B, no delay; delay distance for 1712C-D per A-a; delay distance for 1714A-B per A-c; r4; delay distance for 1714C-D per A-e; delay distance for 1714E-F per A-f; delay distance for 1716A-B per A-g; delay distance for 1716C-D per A-i; delay distance for 1716E-F per A-j; delay distance for 1718C-D per A-m; and delay distance for 1718E-F per A-n.

Figure 24:
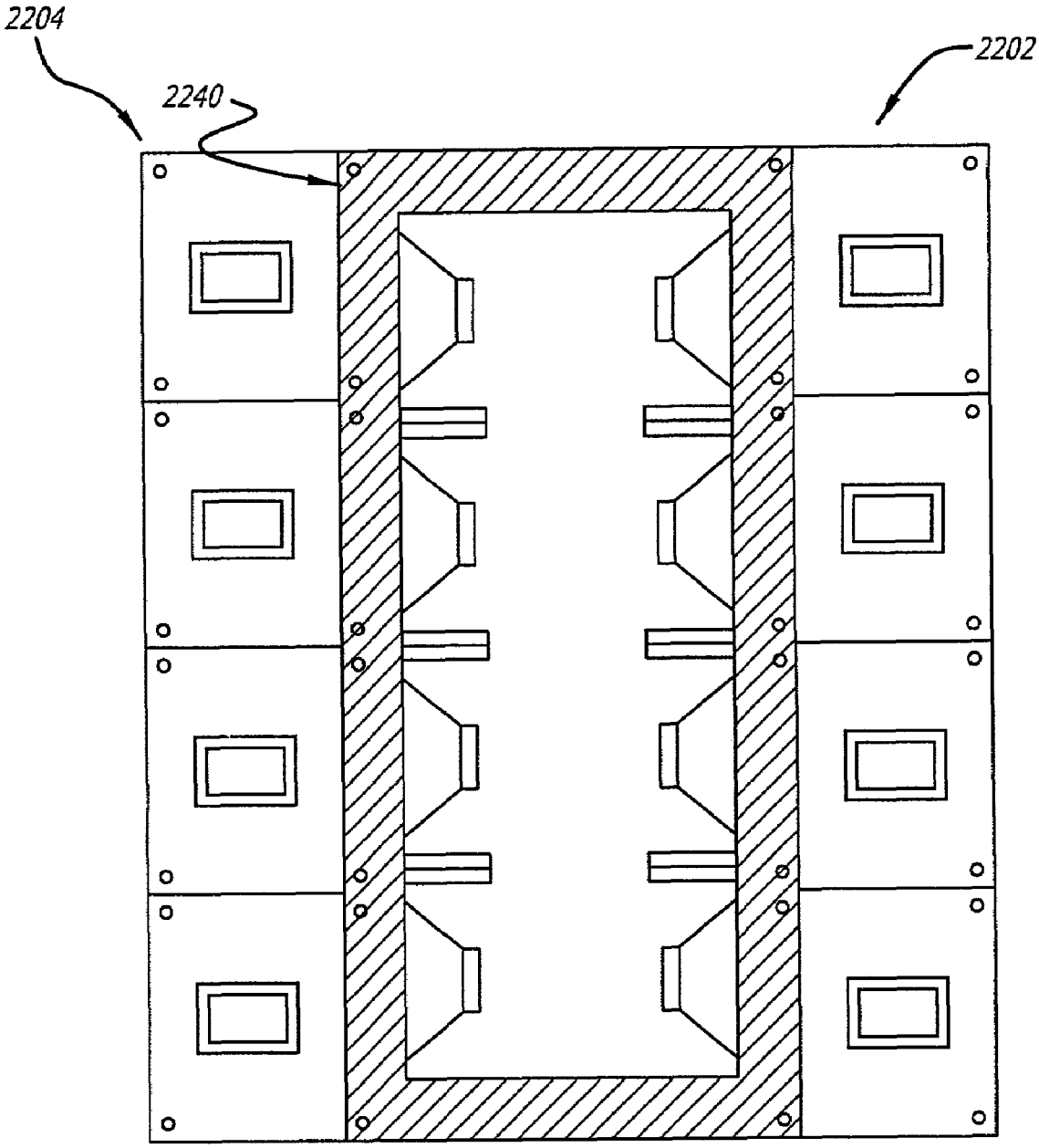
FIG. 24 is a front view of the sound source system of FIG. 22.

FIGS. 22 through 24 illustrate a sound source system 2210 capable of providing a wide horizontal coverage using the sound source 1310 as described in FIG. 13. The assembly 2210 may provide at least a 90° horizontal and 90° vertical coverage patterns between its working bandwidth of about 60 Hz and about 250. For example, sound source system 2210 may include a left-side array 2204 having four sound sources 2224 through 2227; and an right-side array 2202 having four sound sources 2228 through 2231. As illustrated in FIG. 24, a truss member 2240 may be used to couple the right and left arrays 2202 and 2204 such that the electromagnetic motors face one another. This allows the motors to radiate heat more readily, and allows the spacing or the width between the left and right arrays to be flexible so that a desired horizontal coverage may be provided. For wider horizontal coverage, the spacing between the left and right arrays may be narrowed, and conversely, for a narrow horizontal coverage, the spacing may be widened.

The sound source system 2210 may be capable of directing sound by creating a major lobe with definable polar characteristics. The sound lobe vector 2226 may be directed at any angle ϕ from about 0 to about 360° in the x-y plane. Again, the design issues and the geometry of the assembly 2210 may affect the angles ϕ and α in sound source system 1710. All of the sound sources in the assembly 2210 may be operated, or a portion of the sound sources may be operated for different angles ϕ, α and output of SPL.

The sound source system 2210 may utilize the audio system 800 for providing a lobe having a central axis along the vector 2226. The vector 2226 may be designated to begin at any convenient reference point such as between the first and second arrays on a vertical axis 2212 passing through the acoustic center of sound source 2224A.

Two different sound sources may be driven in pairs when the delay distance between the two sound sources and the reference plane is substantially the same such as symmetrically positioned sound sources in the parallel arrays 2202 and 2204. One non-delayed drive signal and seven delayed drive signals may be used. After choosing a direction for the vector 2226, delays may be determined and set in the delay elements. Diameters for all of the sound sources in the sound source system 2210 may be 15 inches (381 mm). Alternatively, sound sources 2224A, 2224B, 2227A, and 2227B may be 18 inches (457.2 mm) and sound sources 2225A, 2225B, 2226A and 2226B may be 12 inches (304.8 mm).

Figure 26:
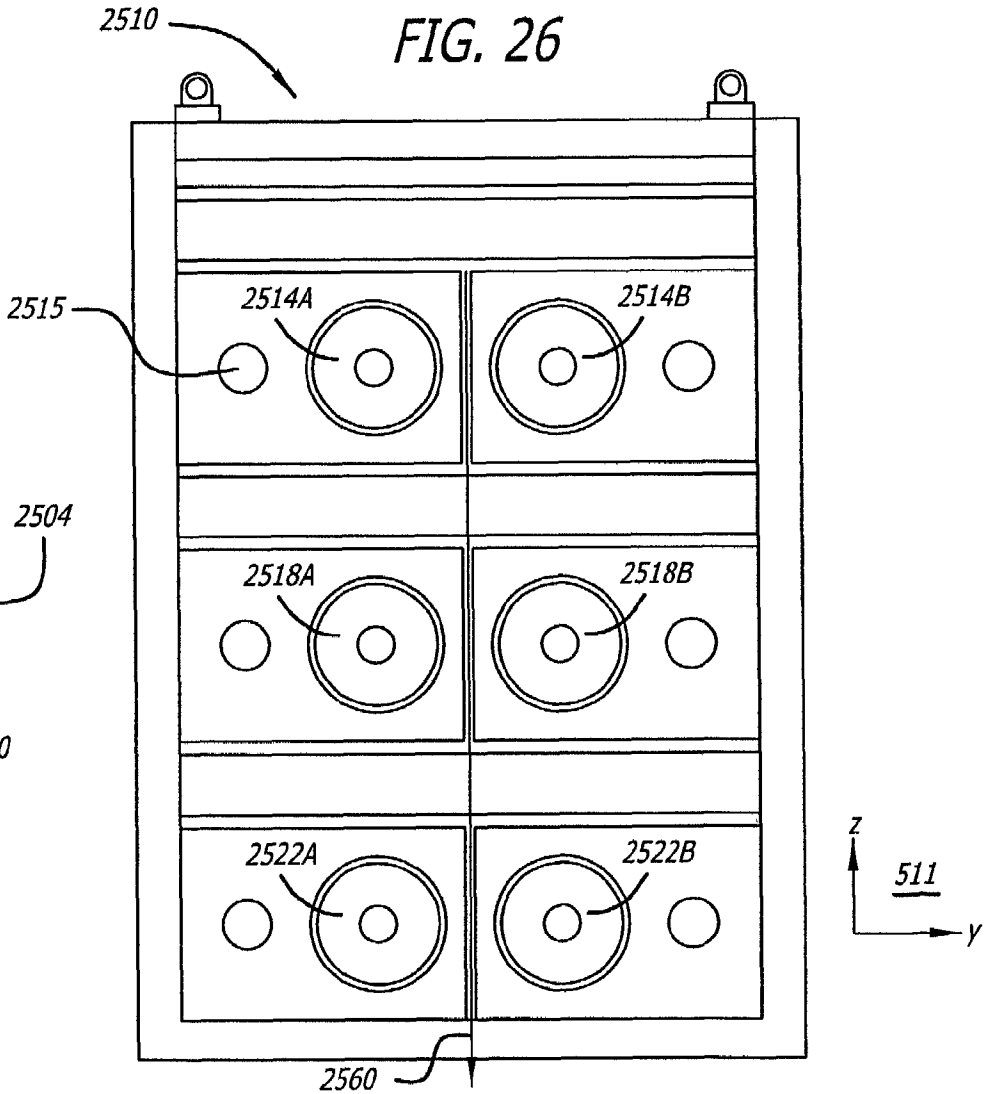
FIG. 26 is a front view of the sound source system of FIG. 25.
Figure 25:
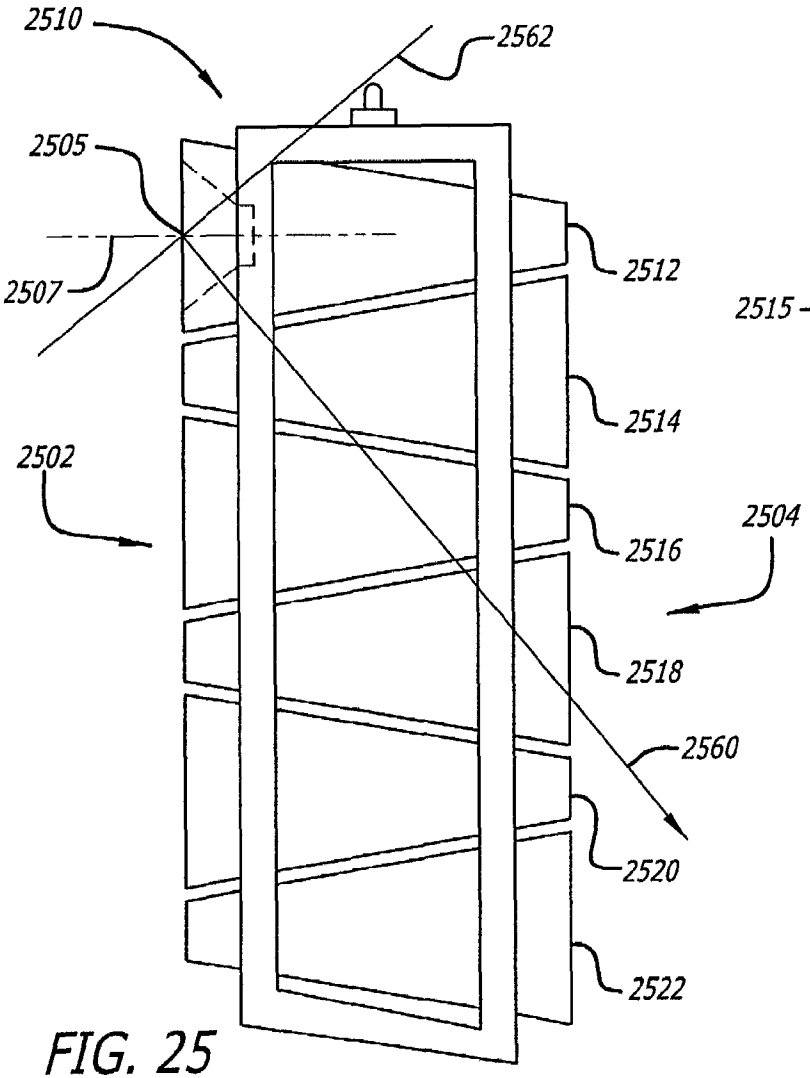
FIG. 25 is a side view of a sound source system comprised of sound source elements of FIGS. 15 and 16.
Figure 27A:
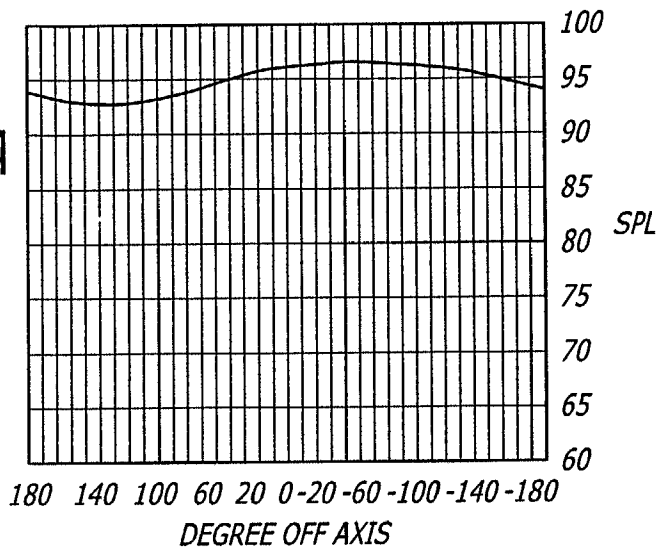
FIG. 27A is graph of sound pressure level at various degrees off the axis for the array in FIGS. 25 and 26 when the sound is directed down 40° at 40 Hz.
Figure 27B:
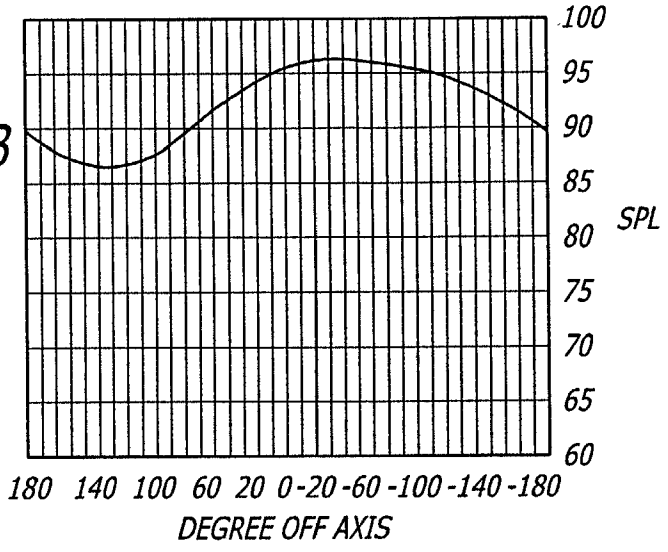
FIG. 27B is graph of sound pressure level at various degrees off the axis for the array in FIGS. 25 and 26 when the sound is directed down 40° at 63 Hz.
Figure 27C:
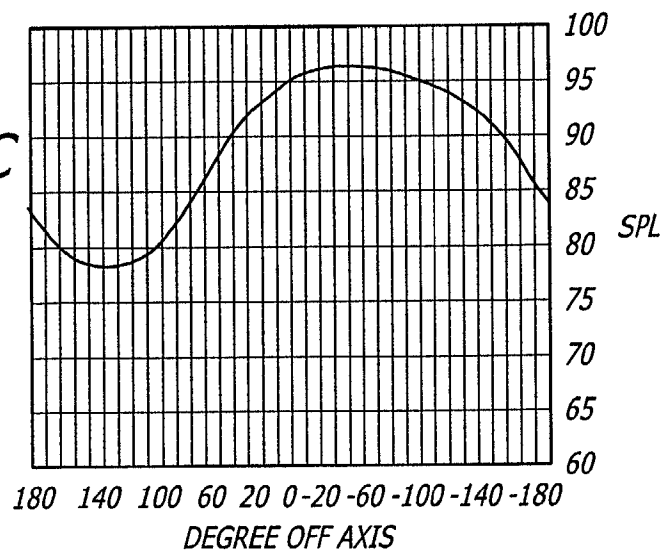
FIG. 27C is graph of sound pressure level at various degrees off the axis for the array in FIGS. 25 and 26 when the sound is directed down 40° at 80 Hz.
Figure 27D:
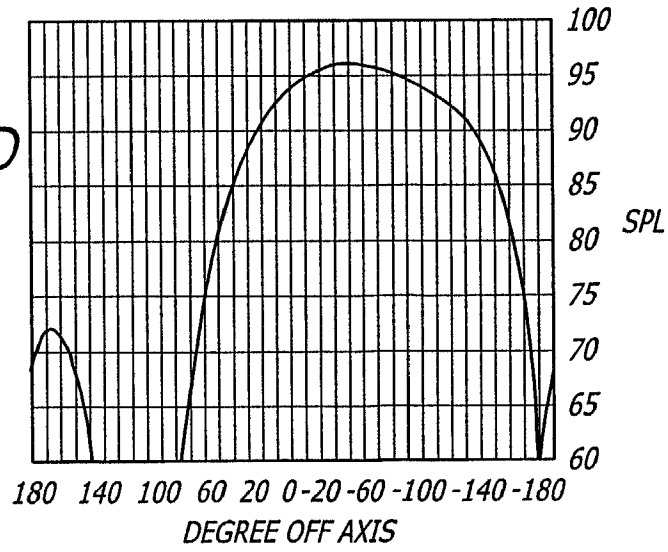
FIG. 27D is graph of sound pressure level at various degrees off the axis for the array in FIGS. 25 and 26 when the sound is directed down 40° at 100 Hz.

FIGS. 25 and 26 illustrate a sound source system 2510 having sound sources particularly suited for larger diameter sound sources. Sound sources 2512-2522 may be of the type described with reference to sound source 1510 in FIGS. 15 and 16. The sound source system 2510 may provide two parallel but offset arrays of sound sources. Array 2502 may include sound sources 2512, 2516, and 2520. Array 2504 may include sound sources 2514, 2518, and 2522. Each array may include six sound sources and six ports. Delay for each sound sources in the two arrays 2502 and 2504 may be proportional to the delay distance for each sound source where the delay distance may be the shortest distance between a reference plane and the sound source. The reference plane 2562 may be normal to a vector 2560 where the sound lobe is aimed at from the sound source system 2510. With the offset arrangement of the sound sources in the two arrays 2502 and 2504, each of two sound sources may have a different delay distance relative to the reference plane. As such, where a pair of sound sources has a delay distance, it may be delayed by a delay element. Hence six drive signals may be used, each with a different delay.

The delay distance for each of the sound sources may be calculated based on the vector 2560 that originates between sound sources 2514A and 2514B. The delay distance for each sound sources may be proportion to the shortest distance from the sound source to a plane 2562 that is normal to the vector 2560.

The larger spacing of the sound sources may be acceptable in the sound source system 2510 because the wavelengths are longer. For example, the wavelengths may vary from approximately 8 to approximately 32 feet. Accordingly, the shadowing effect of the boxes may not be a problem due to the longer wavelength. The array may be forward-steered at the angle desired by delaying each sound source back to a plane normal to the direction aiming. Due to the geometry of the array, the main lobe may look slightly different at different steering angles. The sound source system 2510 may have a greater off-axis rejection when steered downward due to the increase in apparent array length. FIGS. 27A through 27D illustrate a polar response to a six-element array at an aiming angle of 40° down that is suitable for a typical arena. These FIGS. illustrate that the array 2510 covers evenly between 0° and −90° and that it is effective at steering and off-axis rejection.

Figure 28:
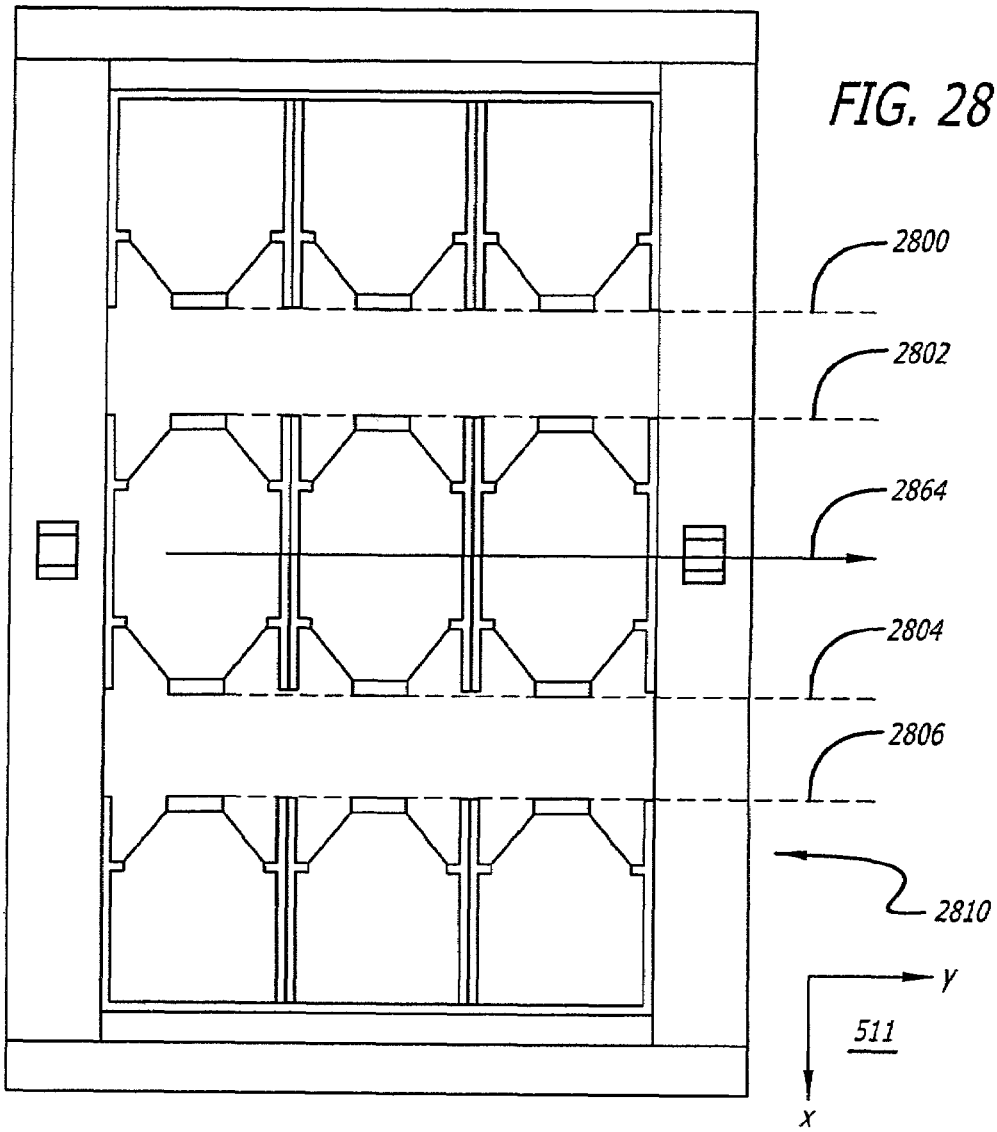
FIG. 28 is a top view of another sound source system.
Figure 29:
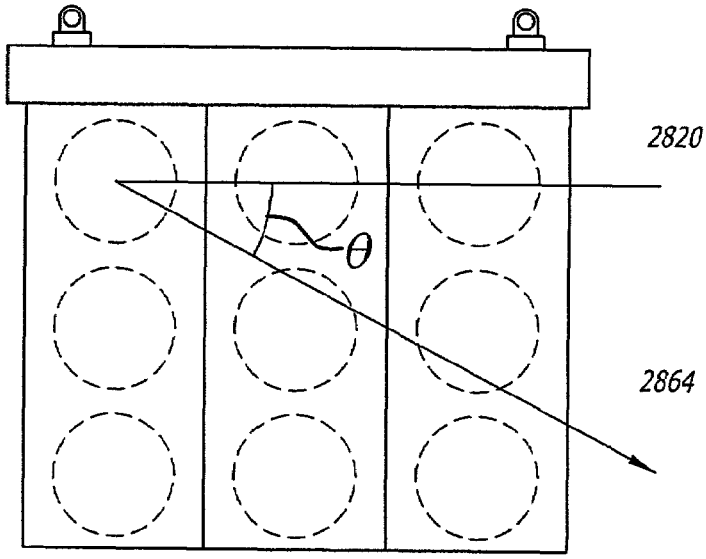
FIG. 29 is a side view of the sound source system of FIG. 28.

FIGS. 28 through 29 illustrate a sound source system 2810 having a plurality of planes of sound sources. In this example, the sound source system 2810 may have four planes of sound sources with two inner planes 2802 and 2804, and two outer planes 2800 and 2806. The two inner planes of sound sources may be made up of the sound sources elements 910 as illustrated in FIGS. 9 and 10. Each of the two outer planes may be made up of the sound source elements 1310 as illustrated in FIGS. 13 and 14 or the sound source elements 1510 as illustrated in FIGS. 15 and 16. For example, the two inner planes may include 12-inch (304.8 mm) sound sources and the two outer planes may include 15-inch (381 mm) and/or 18-inch (457.2 mm) sound sources. The sound source system 2810 may include a base 2840 for supporting all sound sources elements; and for hanging the sound source system 2810.

The sound source system 2810 using delays as discussed above may generate a sound lobe along a vector 2864 that may originate at any point. For example, the vector 2864 may originate at a point 2862 at angle θ from the reference axis 2820. For a more consistent horizontal coverage pattern, the two inner planes that are closer together may be driven with the upper frequency band, and the two outer planes that are spaced further apart may be driven with the lower frequency band. This may be done using frequency shading techniques discussed above.

FIGS. 30 and 31 illustrate a sound source system where two arrays 3002 and 3004 are positioned angled next to each other so that the first ends 3006 and 3008 are closer than the second ends 3010 and 3012. This means that the sound sources near the first end are closer to each other than the sound sources in the second end. With the sound sources near the first end being closer, these sound sources may provide wider coverage pattern at higher frequencies. With the sound sources near the second end being further apart, these sound sources may be driven with lower frequencies because wider spacing in the second end has less affect on the polar characteristics at the lower frequencies. This may be accomplished through frequency-shading technique where the sound sources near the first end are driven with higher frequencies and the sound sources near the second end are driven with lower frequencies. More than two arrays may be positioned angled next to each other in horizontal and/or vertical directions to provide a more consistent coverage pattern in both directions using frequency-shading techniques as well.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A sound source system for directing sound, comprising: a first plurality of sound sources arranged in a first plane, the plurality of sound sources having a first sound source and a second sound source, where the first sound sources lies in a reference plane that is normal to a vector along a central axis of a main sound lobe; and an audio signal source coupled to a delay element that delays an audio signal to the second sound source by an amount proportional to a delay distance, where the delay distance is a distance between the first sound source and a point of intersection between a first line and a second line, where the first line passes through the first sound source perpendicular to the reference plane, and the second line passes through the second sound source perpendicular to the first line.

2. The sound source system according to claim 1, further including an amplifier for amplifying the audio signal to the sound sources.

3. The sound source system according to claim 1, further comprising a second plurality of sound sources arranged in a second plane, where the first and second planes are aligned along a reference axis, where the vector is capable of aiming up to 360° from the reference axis.

4. The sound source system according to claim 1, where the main sound lobe has a width angle and a height angle of about 90°.

5. A sound source system for directing sound, comprising:

a first array of sound sources arranged in a first plane, where each sound source is positioned relative to a reference plane, where the array includes a first sound source located in a reference plane, and a second sound source, where the reference plane is substantially normal to a vector along a central axis of a main sound lobe generated from the first array of sound sources, and where second sound source is coupled to a delay element that delays an audio signal to the second sound source by an amount proportional to a delay distance, where the delay distance is a distance between the first sound source and a point of intersection between a first line and a second line, where the first line passes through the first sound source pendicular to the reference plane, and the second line passes through the second sound source perpendicular to the first line.

6. The sound source system according to claim 5, further comprising a second array of sound sources arranged in a second plane, where the vector for the main sound lobe is positioned between the first plane and the second plane.

7. The sound source system according to claim 5, where the first plane is coupled to the second plane.

8. The sound source according to claim 7, where the first and second planes are aligned along a reference axis, where the vector is capable of aiming up to 360° from the reference axis.

9. The sound source according to claim 7, where the main sound lobe has a width angle and a height angle of about 90°.

10. The sound source system according to claim 5, where the main sound lobe has a lobe height, a lobe width, and a lobe depth, and each array of sound sources has a corresponding array height, array width, and array depth, where adding more sound sources to at least one of the arrays of sound sources along the corresponding array width reduces the lobe height; and where adding more sound sources to the at least one array of sound sources along the corresponding array depth adds power to the main sound lobe and increases an off-axis rejection.

11. The sound source system according to claim 5, where the delay element delays the audio signal based on a time it takes for wave fronts to travel the delay distance.

12. The sound source system according to claim 6, where the sound sources in the first plane are symmetrical to the sound sources in the second plane, respectively.

13. The sound source system according to claim 12, where third sound source is positioned in the second plane, and where the second and third sound sources are both coupled to the delay element.

14. The sound source system according to claim 6, where the arrays of sound sources are assembled from dual sound source elements, where each of the dual sound source elements has a cavity between two sound sources that are mounted on a base, where electromagnetic motors for each of the two sound sources face away from each other.

15. The sound source system according to claim 14, where the bases for each dual sound source elemcnt are adapted to be assembled together to form columns and rows of the dual sound elements.

16. The sound source system according to claim 14, where each of the two sound sources for each dual sound source element has a cone having a diameter between about 4 inches (101.6 mm) and about 36 inches (914.4 mm).

17. The sound source system according to claim 14, where each of the two sound sources for each dual sound source element has a cone having a diameter of about 12 inches (3.048 mm).

18. The sound source system according to claim 17, where outer ends of the cones of the two sound sources are spaced about 0.2 to 0.3 times a predetermined operating frequency wavelength.

19. The sound source system according to claim 17, where outer ends of the cones of the two sound sources are spaced at least about 0.2 times a predetermined operating frequency wavelength.

20. The sound source system according to claim 17, where outer ends of the cones of the two sound sources are spaced less than about 0.3 times a predetermined operating frequency wavelength.

21. The sound source system according to claim 14, where each of the dual sound source elements operates between about 50 Hz and about 250 Hz frequency range.

22. The sound source system according to claim 6, where the arrays of sound sources are assembled from dual sound source elements, where each of the sound source elements includes two sound sources mounted into a base so as to form a first cavity between the base and a first of the two sound sources, and a second cavity between the base and a second of the two sound sources, where a divider wall separates the first cavity and the second cavity, and electromagnetic motors for each of the two sound sources face out.

23. The sound source system according to claim 22, where the bases for each of the sound source elements are adapted to be assembled together.

24. The sound system according to claim 23, where the first plane the second plane are arranged with a space between the first and second planes, and where electromagnetic motors of the sound sources in the first plane face electromagnetic motors of the sound sources in the second plane.

25. The sound source system according to claim 24, where a truss member is used to couple the first array of sound sources and the second array of sound sources.

26. The sound source system according to claim 23, where each of the two sound sources for each sound source element have a cone diameter between about 4 inched (101.6 mm) and about 36 inches (914.4 mm).

27. The sound source system according to claim 22, where each of the two sound sources for each sound source element has a cone having a diameter of about 15 inches (381 mm).

28. The sound source system according to claim 22, where the sound source elements operated between about 50 Hz and about 250 Hz frequency range.

29. The sound source system according to claim 22, where the arrays of sound sources are assembled from dual sound source elements, where each dual sound source element includes two sound sources housed in a box having a port.

30. The sound source system according to claim 29, where each box has a trapezoidal side cross-section, where the boxes are stacked together to from the first and second planes of sound sources, and where the sound sources in the first plane are offset relative to the sound sources in the second plane.

31. The sound source system according to claim 29, where each of the sound sources has a cone having a diameter of between about 4 inches (101.6 mm) and about 36 inches (914.4 mm).

32. The sound source system according to claim 29, where each of the sound sources has a cone having a diameter of about 18 inches (457.2 mm).

33. The sound source system according to claim 29, where each of the sound sources operate between about 25 Hz and about 125 Hz frequency range.

34. The sound source system according to claim 6, where the first plane forms an angle relative to the second plane, where the first and second planes are closer to each other at a first end than at a second end, and where sound sources positioned near the first end are driven with a higher frequency audio signal than the sounds sources positioned near the second end.

35. A sound source system, comprising:

at least one sound source element having a pair of sound sources, each sound source including a cone and an electromagnetic motor, where the pair of sound sources, comprising a first sound source and a second sound source, is positioned within a base such that a cavity is formed between the respective cones and the respective electromagnetic motors face outward, and where the base is configured to stack multiple sound source elements into columns and rows, such that each sound source is positioned relative to a reference plane that is substantially normal to a vector along a central axis of a main sound lobe, where the first sound source lies in the reference plane, and the second sound source is coupled to a delay element that delays an audio signal to the second sound source by an amount proportional to a delay distance, where the delay distance is a distance between a point of intersection between a first line and a second line, where the first line passes through the first sound source perpendicular to the reference plane, and the second line passes through the second sound source perpendicular to the first line.

36. A method for directing sound, comprising:

grouping a first plurality of sound sources into a first plane, where the plurality of sound sources includes a first sound source and a second sound sources, where each sound source in the plurality of sound sources is positioned relative to a reference plane that is substantially normal to a vector along a central axis of a main sound lobe generated from the sound sources, and where a first sound source lies in the reference plane; and delaying an audio signal to at least one sound source by an amount proportional to a delay distance, where the delay distance is a distance between first sound source and a point of intersection between a first line and a second line, where the first line passes through the first sound source perpendicular to the reference plane. and the second line passes through the second sound source perpendicular to the first line.

37. The method according to claim 36, further including amplifying the audio signal to each sound source.

38. The method according to claim 36, further comprising:

grouping a second plurality of sound sources into a second plane;

positioning the sound sources in the first plane symmetrically relative to the sound sources in the second plane; and delaying the audio signal to the first sound source in the first plane and a third sound source in the second plane via one delay element, where the first sound source and the third sound have substantially the same delay distance.

39. The method according to claim 36, further including stacking the sound sources so that the sound sources in the first are offset relative to the sound sources in the second plane.

40. The method according to the claim 39, further including stacking the sound sources to form an array having columns and rows of sound sources, where eletromagnetic motors for each of the sound sources in the first and second planes face out.

41. The method according to claim 39, furthering including:

assembling the sound sources to form a first array and a second atray, where electromagnetic motors for the sound sources in the first and second arrays face out, and where the first array defines the first plane and the second array defines the second plane;

spacing the first and second arrays to control a width of the main sound lobe; and coupling the first and second arrays so that the magnetic motors from the sound sources in the first array face the magnetic motors from the sound sources in the second array.

42. The method according to claim 39, further including spacing the first plane from the second plane to control a width of the main sound lobe.

43. The method according to claim 39, further including positioning the first and second planes substantially parallel to each other.

44. The method according to claim 36, further including frequency shading the audio signal to provide the main sound lobe with consistent coverage vertically along most operating frequencies.

45. A method for directing sound, comprising:

defining a vector along a central axis of a main sound lobe and a reference plane that is normal to the vector;

grouping a first plurality of sound sources into a first plane, where said first plurality of sound sources includes a first sound source that lies in the reference plane, and a second sound source;

coupling a common signal source to each sound source; and delaying an audio signal to at the second sound source by an amount proportional to a delay distance, where the delay distance is a distance between the at first sound source and a point of intersection between a first line and a second line, where the first line passes through the first sound source perpendicular to the reference plane, and the second line passes through the second sound source perpendicular to the first line.

* * * * *